US011426671B2

(12) United States Patent
Cao

(10) Patent No.: US 11,426,671 B2
(45) Date of Patent: Aug. 30, 2022

(54) STACKABLE TRACK FRAME WITH BOOSTER

(71) Applicant: Mattel, Inc., El Segundo, CA (US)

(72) Inventor: Kevin Cao, Reseda, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 17/164,884

(22) Filed: Feb. 2, 2021

(65) Prior Publication Data

US 2021/0236949 A1 Aug. 5, 2021

Related U.S. Application Data

(60) Provisional application No. 62/969,840, filed on Feb. 4, 2020.

(51) Int. Cl.

| | |
|---|---|
| ***A63H 18/02*** | (2006.01) |
| ***A63H 33/04*** | (2006.01) |
| ***A63H 18/00*** | (2006.01) |

(52) U.S. Cl.

CPC ..... *A63H 18/026* (2013.01); *A63H 18/00* (2013.01); *A63H 18/02* (2013.01); *A63H 33/044* (2013.01)

(58) Field of Classification Search

CPC ..... A63H 18/00; A63H 18/02; A63H 18/026; A63H 17/008; A63H 17/44; A63H 33/044; A63H 33/42

See application file for complete search history.

(56) References Cited

U.S. PATENT DOCUMENTS

| | | | | |
|---|---|---|---|---|
| 3,225,487 | A * | 12/1965 | Mallalieu | A63H 18/02 211/188 |
| 3,590,524 | A | 7/1971 | Beny | |
| 3,622,158 | A | 11/1971 | Tepper | |
| 3,641,704 | A | 2/1972 | Sims | |
| 3,653,146 | A * | 4/1972 | Goldfarb | A63H 17/44 446/423 |
| 3,690,031 | A | 9/1972 | Shinoda | |
| 3,777,394 | A | 12/1973 | Staats | |
| 3,949,516 | A * | 4/1976 | Gronert | A63H 17/44 446/423 |
| 4,433,504 | A | 2/1984 | Terui | |
| 5,451,177 | A * | 9/1995 | Gilman | A63F 7/3622 446/128 |

(Continued)

FOREIGN PATENT DOCUMENTS

| | | | | |
|---|---|---|---|---|
| GB | 2525278 A | * | 10/2015 | A63H 17/44 |
| WO | WO-0010670 A1 | * | 3/2000 | A63H 17/44 |

*Primary Examiner* — Eugene L Kim
*Assistant Examiner* — Alyssa M Hylinski
(74) *Attorney, Agent, or Firm* — Edell, Shapiro & Finnan, LLC

(57) ABSTRACT

A stackable track assembly and method for stacking a booster and/or track frame is disclosed. The stackable track assembly includes a base, a track portion disposed in the base, and a frame extending out of the base and laterally across the top of the base. The stackable track assembly further includes a tab and slot for laterally coupling two track assemblies. The stackable track assembly further includes a receiving member and engagement member for vertically and/or laterally coupling two track assemblies. In some implementations, the track assembly may include a booster for accelerating a toy vehicle.

17 Claims, 24 Drawing Sheets

(56) References Cited

U.S. PATENT DOCUMENTS

| | | | | |
|---|---|---|---|---|
| 6,241,573 | B1 * | 6/2001 | Ostendorff | A63H 18/06 446/444 |
| 6,273,778 | B1 * | 8/2001 | Kyster | A63H 33/042 446/85 |
| 6,695,675 | B1 * | 2/2004 | Ngan | A63H 17/008 446/444 |
| 7,387,559 | B2 | 6/2008 | Sanchez-Castro | |
| 7,637,796 | B2 | 12/2009 | Hippely | |
| 7,648,407 | B1 * | 1/2010 | Sorensen | A63H 33/084 446/124 |
| 7,794,301 | B2 | 9/2010 | Ostendorff | |
| 7,955,158 | B2 | 6/2011 | Filoseta | |
| 8,011,994 | B2 | 9/2011 | Fink | |
| 8,951,091 | B2 | 2/2015 | Payne | |
| 9,409,097 | B2 | 8/2016 | Comfort | |
| 9,586,155 | B2 | 3/2017 | Hong | |
| 2004/0198166 | A1 | 10/2004 | Newbold | |
| 2006/0084361 | A1 | 4/2006 | Favorito | |
| 2007/0060012 | A1 | 3/2007 | Comfort | |
| 2011/0014844 | A1 | 1/2011 | Henson | |
| 2011/0250822 | A1 | 10/2011 | Koehl | |
| 2013/0126628 | A1 | 5/2013 | DiBartolo | |
| 2013/0231028 | A1 | 9/2013 | Ostendorff | |
| 2014/0326798 | A1 | 11/2014 | O'Connor | |
| 2015/0367247 | A1 * | 12/2015 | Kosmo | A63H 33/086 29/428 |
| 2017/0106303 | A1 | 4/2017 | O'Connor | |
| 2017/0144081 | A1 * | 5/2017 | Jichi | A63H 33/088 |
| 2017/0274291 | A1 | 9/2017 | Cherednichenko | |
| 2018/0117481 | A1 | 5/2018 | Shuck | |
| 2019/0143231 | A1 | 5/2019 | Santos | |
| 2019/0224580 | A1 | 7/2019 | Schmid | |

* cited by examiner

STACKABLE TRACK FRAME WITH BOOSTER

CROSS REFERENCE TO RELATED APPLICATIONS

This application claims priority to and is based on U.S. Provisional Application No. 62/969,840 filed on Feb. 4, 2020, entitled "Stackable Track Frame with Booster," the entire disclosure of which is incorporated herein by reference.

FIELD OF INVENTION

The present invention relates to the field of toy vehicle boosters and, in particular, stackable vehicle boosters for toy racetracks.

INTRODUCTION

Toy vehicles continue to be popular products. Racetracks for racing toy vehicles may be set up in multiple configurations. They may be open or closed looped. The toy vehicles used in trackways can be free-wheeling unpowered vehicles or vehicles which utilize an onboard power drive mechanism. When unpowered vehicles are used on racetracks (i.e., toy vehicle track sets), accelerating devices may be provided for accelerating the toy vehicles on the racetrack. Such accelerating devices are known generally in the art as "boosters" and often include one or more motor driven rotating wheels adjacent a track portion of the racetrack. As a vehicle passes through the booster, the rotating wheels temporarily engage the passing toy vehicle and impart a force thereto. A common type of booster employs a pair of spaced apart wheels on either side of a toy vehicle travel path which operate in conjunction to engage the passing toy vehicle from both sides to impart an acceleration force. Another type of booster employs a single wheel radially spaced above the track such that an upper surface of the vehicle engages the circumference of the wheel as the vehicle travels beneath the wheel.

Generally, track portions may be arranged to create a racetrack in multiple configurations. For example, boosters may be arranged side by side or at different portions of the race track. However, greater flexibility in arrangements of boosters and track portions may be desirable, for example, to increase or extend the play value of a track set.

SUMMARY

The present invention relates to a stackable track frame with a booster. In accordance with at least one embodiment of the present invention, the stackable track frame includes a base, a track portion disposed in the base, and a frame extending out of the base and laterally across a top of the base. The stackable track frame further includes a tab and slot for laterally coupling two track frames. Additionally or alternatively, the stackable track frame may include a receiving member and engagement member for vertically and/or laterally coupling two track frames. In some implementations, the frame may include a booster for accelerating a toy vehicle.

BRIEF DESCRIPTION OF THE DRAWINGS

To complete the description and in order to provide for a better understanding of the present invention, a set of drawings is provided. The drawings form an integral part of the description and illustrate an embodiment of the present invention, which should not be interpreted as restricting the scope of the invention, but just as an example of how the invention can be carried out. The drawings comprise the following figures.

DETAILED DESCRIPTION

Figure 1A:
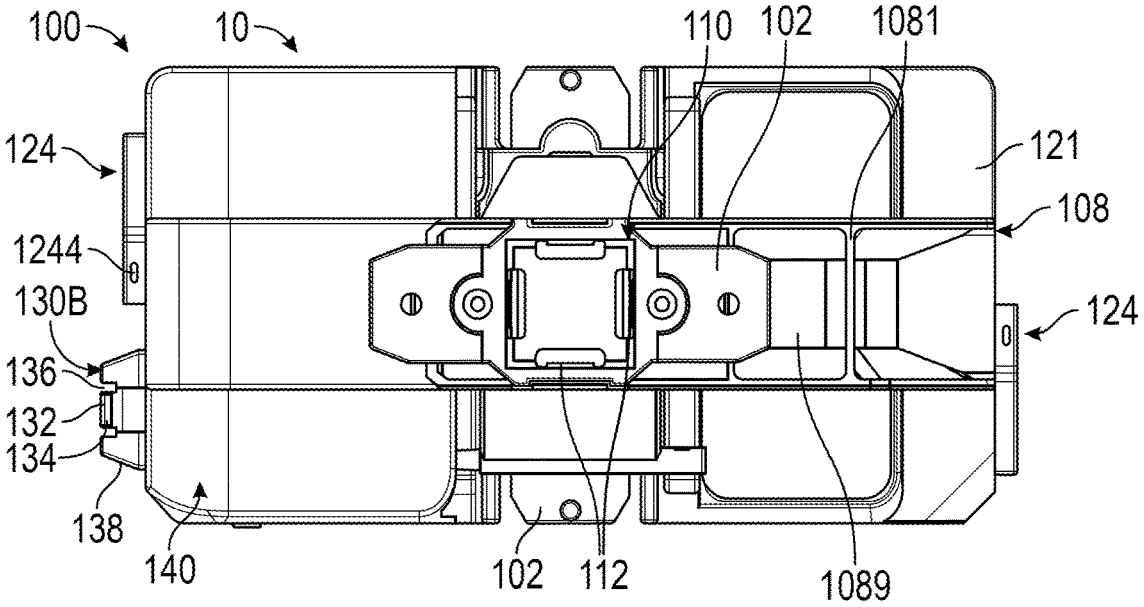
FIG. 1A is a top view of a booster, according to an exemplary embodiment.
Figure 1B:
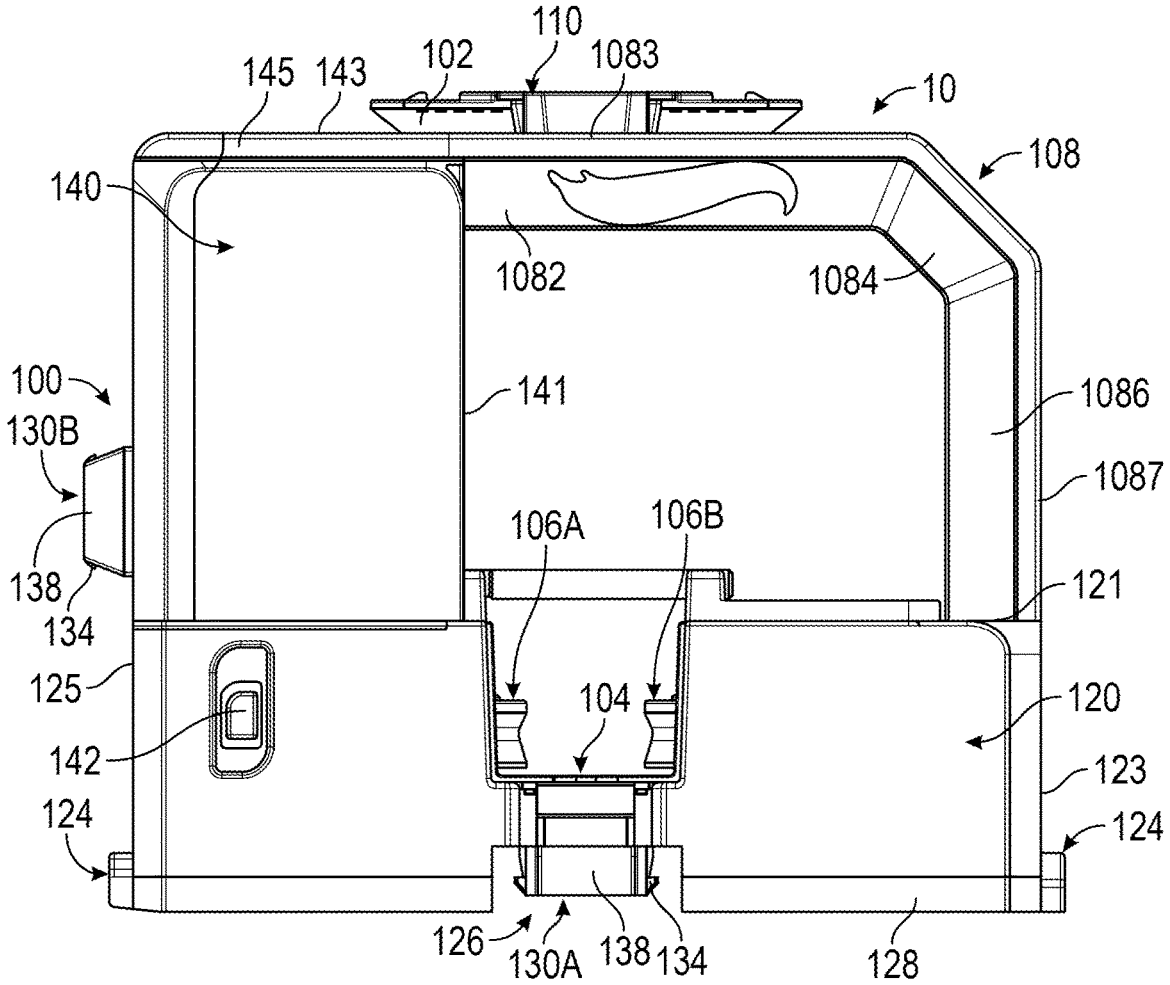
FIG. 1B is a front view of the booster of FIG. 1A.

The following description is not to be taken in a limiting sense but is given solely for the purpose of describing the broad principles of the invention. Embodiments of the invention will be described by way of example, with reference to the above-mentioned drawings showing elements and results according to the present invention.

Generally, the track and booster assemblies presented herein enable stacking of boosters and track frames in a variety of arrangements. Each stackable track assembly may include a track portion and frame extending over the track portion. Each stackable booster may include a base, a track portion and a motor-driven rotating wheel on a side of the track portion that engages with and accelerates, or boosts, a toy vehicle passing through the booster. The track portion and wheel may be disposed in the base. In some implementations, the booster may include a plurality of wheels. Additionally, a battery compartment that may receive batteries may be positioned on a side of the stackable booster. The battery compartment may be disposed on or above the motor-driven rotating wheel. On the opposite side of the base, a frame may extend vertically to connect to the top surface of the battery compartment. The frame may bridge over the track portion and any motor-driven rotating wheels included in the stackable booster.

The track and/or booster assemblies may be removably coupled to one another through engagement members and corresponding receiving members. The engagement members may be disposed at a lateral side of the battery compartment and on a bottom of the booster. Receiving members may be disposed at a lateral side of the battery compartment and a top portion of the frame. The boosters may be stacked and held in place via the engagement and receiving members in a variety of arrangements and orientations. The boosters may further include tabs and slots disposed at a base of the booster and/or track frame. For example, a tab of a first booster or track frame may engage a corresponding slot of a second booster or track frame to laterally or horizontally couple the first booster/track frame to a second booster or track frame. Thus, the engagement and receiving members, as well as the tabs and slots allow a plurality of boosters and/or frames to be coupled together in a variety of arrangements. The variety of arrangements, orientations, and stackings of the boosters and/or track frames can provide complex three-dimensional racetrack layouts.

Now referring to FIG. 1A-8 for a description of an exemplary embodiment of a stackable booster 10. The stackable booster 10 may include a plurality of track tabs 102, a track portion 104, a main housing 100, a frame 108, and a booster wheel 106A. In the depicted embodiment, the main housing 100 includes a base 120 and a battery compartment 140 that extends upwards from the base 120. However, in other embodiments, the base 120 could be L-shaped and the battery compartment 140 could be included in any portion of the base 120. Thus, in some instances, the battery compartment 140 may be referred to herein as an upward extension 140 of base 120.

Moreover, in the depicted embodiment, a motor (not shown) may be disposed in the base 120 and/or battery compartment 140 and may be configured to drive the booster wheel 106A. The battery compartment 140 may be configured to receive one or more batteries for supplying power to the motor. The battery compartment 140, base 120, and frame 108 may also include one or more of a receiving members 110, engagement members 130, tabs 124 and/or slots 122. A receiving member 110 and engagement member 130 may cooperate to retain a first track and/or booster assembly on a second track and/or booster assembly. Similarly, a tab 124 may cooperate with a slot 122 to retain a first track and/or booster assembly on or adjacent a second track and/or booster assembly.

The track portion 104 may be disposed adjacent to the booster wheel 106A and provides a pathway for a vehicle to travel while being boosted by the stackable booster 10. In the depicted embodiment, the booster 10 also includes a second booster wheel 106B disposed in the base 120 and the track portion 104 disposed between the booster wheels 106A, 106B. However, in other embodiments, the booster 10 might only include one booster wheel (e.g., booster wheel 106A) or may include more than two booster wheels.

The booster may further include a switch 142 for toggling the booster motor between on and off. The switch 142 may also toggle a direction in which booster wheel 106A and/or booster wheel 106B spins. For example, the switch 142 may be a three-way switch for toggling the motor, and thus the wheel 106A and/or wheel 106B, between rotating in a first direction, rotating in a second direction, and off.

Track tab 102 may be configured to engage a track member (e.g., a piece of track) that provides a portion of a raceway for a toy vehicle to travel. For example, first and second track members may include female connectors that can engage the tabs 102 so that the first and second track members can engage track tabs 102 and extends forwards and rearwards from the track portion 104. A vehicle traveling along the first track member may enter the booster 10 at the track portion 104. The booster wheel 106A may engage the vehicle as it travels along the track portion 104, thereby imparting a force to the vehicle. The vehicle may be accelerated towards the second track member in response to the force imparted by the booster wheel 106A.

In some implementations, the first booster wheel 106A and the second booster wheel 106B are linked booster wheels. That is, the first booster wheel 106A and the second booster wheel 106B may be driven at the same rotational speed. For example, the first booster wheel 106A might be mounted on a first booster wheel gear that is large enough to directly engage the second booster wheel gear of the second booster wheel 106B (and only one of gears might engage the motor). As another example, booster wheels 106A and 106B could be linked via separate motors that are communicating via a wired or wireless connection. That is, booster wheels 106A and 106B might be electronically linked instead of mechanically linked. Still further, in some embodiments, booster wheels 106A and 106B need not be linked and can be operated at the same speed or different speeds.

In a preferred embodiment, the booster wheels 106A and 106B are linked to operate at the same speed so that they impart the same accelerating force to the toy vehicles passing through track portion 104. Having the booster wheels 106A and 106B operating at the same speed ensures that a toy vehicle sized to travel along the track portion 104 receives the same accelerating force on both sides of the toy vehicle and travels straight when exiting the booster 10. Put another way, having the booster wheels 106A and 106B operate at different speeds may, in certain instances, cause a toy vehicle traveling along the track portion 104 to spin when exiting the booster 10. Moreover, in instances where multiple vehicles are racing against each other within a track set that includes two boosters, such as the boosters 10 and 10' included in the track layout 800 of FIG. 16, having the booster wheels 106A and 106B of each booster 10 or 10' operate at the same speed may prevent a toy vehicle from gaining an unfair advantage over other toy vehicles by passing through a particular booster 10 or 10'.

Moreover, although booster wheels 106A and 106B are only partially shown in the Figures, it is to be understood that booster wheels 106A and 106B can have any shape, for example, to enhance flexibility, durability, grip, etc. and ensure that booster wheels 106A and 106B can accommodate and engage a toy vehicle passing along track portion 104 to accelerate the toy vehicle (e.g., to "boost" the toy vehicle). The flexibility of booster wheels 106A and 106B may also allow the booster wheels 106A and 106B to accommodate toy vehicles of slightly varied widths. As one example, the booster wheels 106A and 106B may have an S-shape that allows the relative distance between the booster wheels 106A and 106B to change, as is disclosed in U.S. Pat. No. 7,955,158 to Filoseta et al., which is incorporated by reference in its entirety. Additionally or alternatively, the booster wheels 106A and 106B may have a plurality of apertures, as is disclosed in U.S. Pat. No. 6,793,554 to Newbold, which is also incorporated by reference in its entirety.

Figure 8:
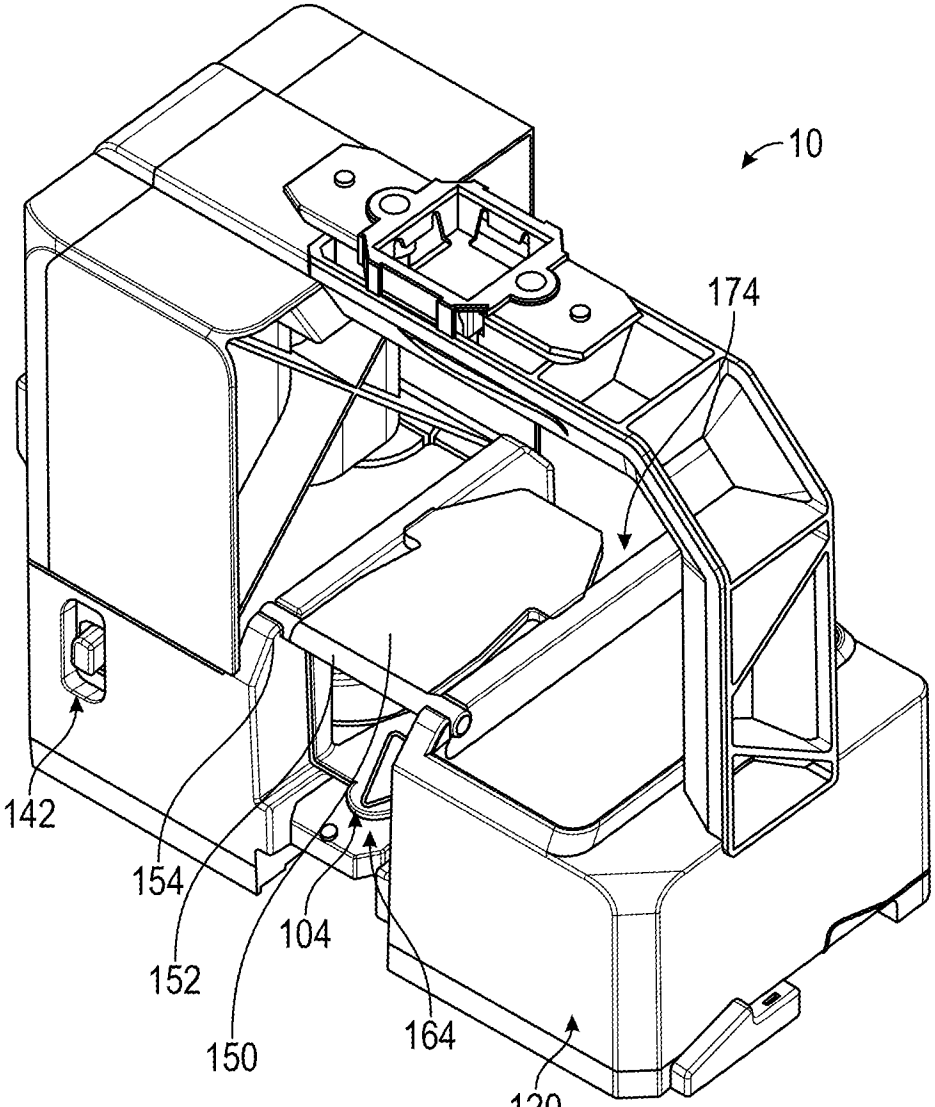
Figure 9B:
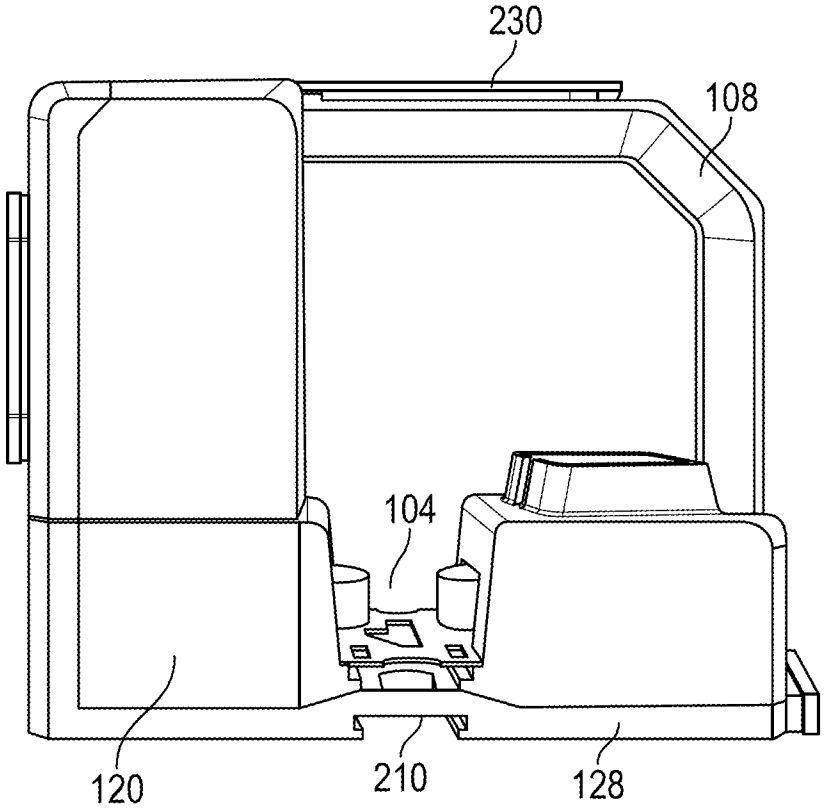
FIG. 9B is a front view of the booster of FIG. 9A.
Figure 9A:
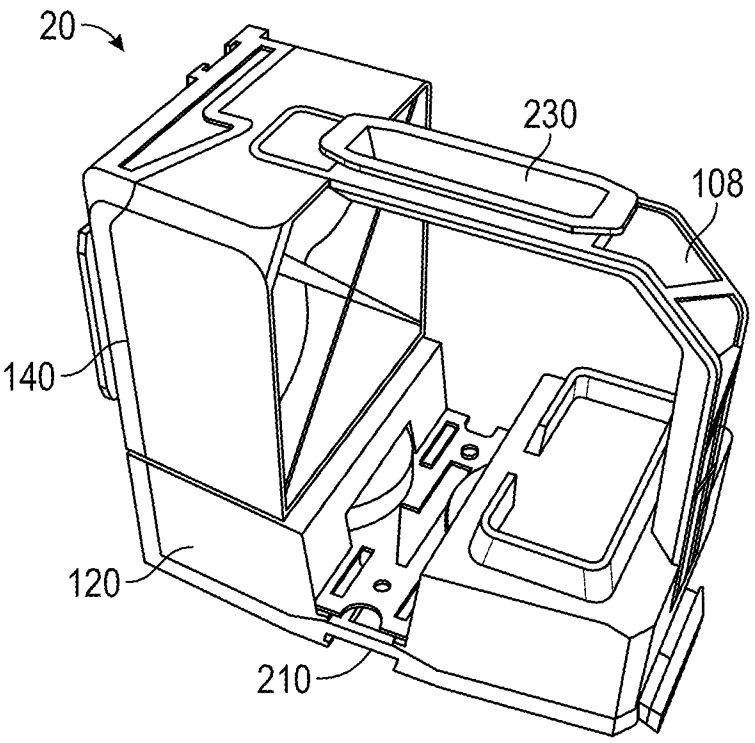
FIG. 9A is a perspective view of a booster, according to another exemplary embodiment.
Figure 9D:
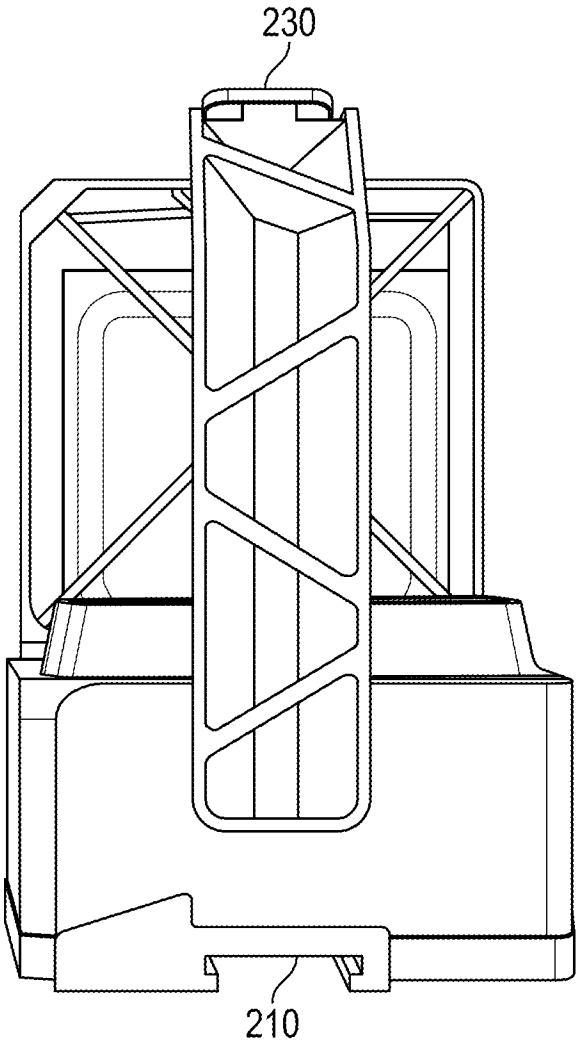
FIG. 9D is another side view of the booster of FIG. 9D.
Figure 9C:
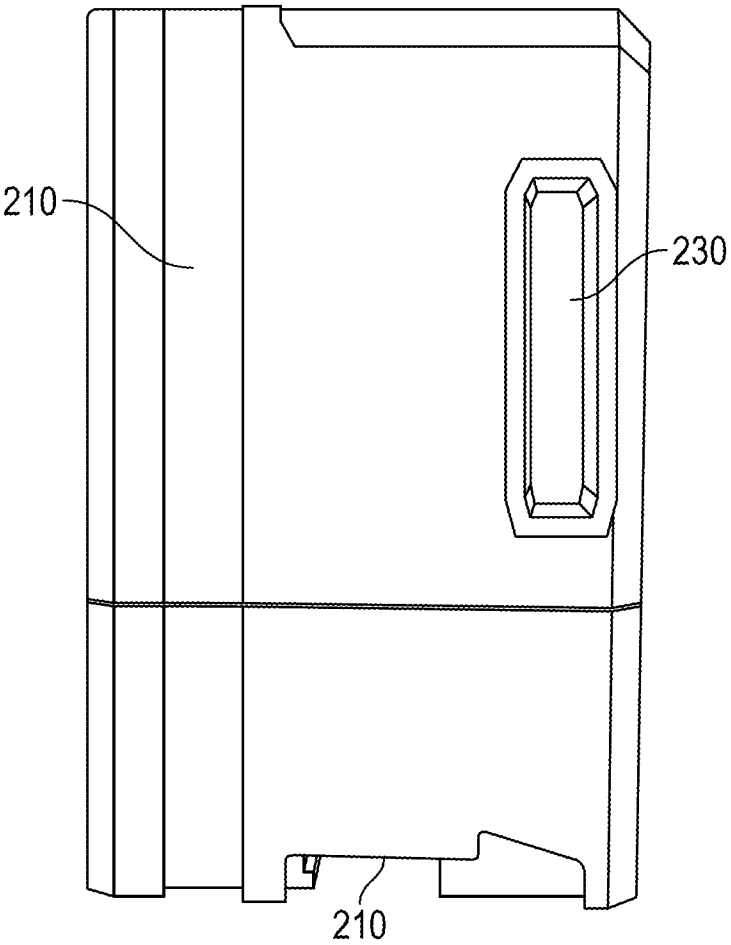
FIG. 9C is a side view of the booster of FIG. 9A.

In some implementations, the booster 10 may include a pivotable cover 150 for preventing a toy vehicle from improperly exiting the booster, e.g., exiting with a vertical trajectory with respect to the path defined by track portion 104. Referring to FIG. 8, the cover 150 includes a support 152 and the base 120 includes a plurality of pivot holes 154 for receiving the support 152. The supports 152 may be pivotably coupled to the base 120 via the pivot holes 154. The cover 150 may be rotated about the support 152 and pivot holes 154 and positioned relative to the direction of boost. For example, as depicted in FIG. 8, the cover 150 is position such that a toy vehicle entering the track portion 104 at portion 164 is boosted towards portion 174. When the booster is reversed and the toy vehicle enters the booster 10 at portion 174 and is boosted towards portion 164, a user may flip or rotate the cover 150 about the support 152. For example, the cover 150 may be rotated 180 or more degrees about the support 152. Thus, the pivotable cover 150 may prevent toy cars entering the booster in either direction from being vertically removed from the track portion 104.

Still referring to FIGS. 1A-8, the battery compartment 140 may extend from the base 120. The frame 108 connects an upper surface 121 of the base 120 to a connection portion 145 protruding from a top 144 of the battery compartment 140. For example, in the depicted embodiment, the frame 108 includes a horizontal or lateral portion 1082, an angled portion 1084, and a vertical portion 1086. The lateral portion 1082 extends horizontally from the connection portion 145 of the battery compartment 140 and the vertical portion 1086 extends vertically from the upper surface 121 of the base 120. Additionally, in the depicted embodiment, an upper surface 1083 of the lateral portion 1082 of the frame 108 and an upper surface 143 of connection portion 145 of the battery compartment 140 are coplanar. Additionally, a lateral surface 1087 of the vertical portion 1086 of the frame 108 and a lateral surface 123 of the base 120 may be coplanar. The angled portion 1084 may connect the lateral portion 1082 and vertical portion 1086 of the frame 108. Thus, the frame 108 extends up from the base 120, over and across the base 120 to the battery compartment 140, bridging the track portion 104. Accordingly, the frame 108, base 120, and battery compartment 140 form a support structure for supporting another booster or track assembly. In some implementations, the upper surface 1083 and the lateral surface 1087 of the frame may include a plurality of depressions 1089 defined by a plurality of support structures 1081. The plurality of support structures 1081 and depressions may define a truss arrangement.

Still referring to FIGS. 1A-8, the engagement member 130 may be disposed on the battery compartment 140 and/or the base 120. For example, the engagement member 130 may be disposed on a lateral surface of the battery compartment 140. Additionally, or alternatively, an engagement member 130 may be disposed within a slot or depression 126 of the base 120. For example, the slot or depression 126 may extend into the bottom of the base 120. The engagement member 130 may extend from a bottom surface of the base 120 into the depression 126. In some implementations a first engagement member 130A may disposed on the base 120 and a second engagement member 130B may be disposed on the battery compartment 140. That is, a first engagement member 130A may be disposed on a bottom of booster 10 and a second engagement member 130B may be disposed on a side of booster 10.

The engagement member 130 may include a protrusion extending from a surface of the stackable booster 10. In some implementations the protrusion may be defined by a sidewall 138 extending from the surface. The sidewall 138 may include a plurality of gaps 136 which may define a finger 132. The finger 132 may include a tooth 134. The tooth 134 may be configured to engage a surface of the receiving member 110. The gap 136 may provide increased flexibility to the finger 132 as compared to a sidewall 138 without the gap 136. In some implementations, the engagement member 130 may have four sidewalls 138. In some implementations, the sidewalls 138 may be angled with respect to the surface of the stackable booster 10. In some implementations, the finger 132, gap 136, and tooth 134 are disposed on one sidewall 138 of the engagement member 130. In some implementations, two opposing sidewalls 138 each include a finger 132, gap 136, and tooth 134. In some implementations one or more sidewalls 138 each include a finger 132, gap 136, and tooth 134.

Figure 2:
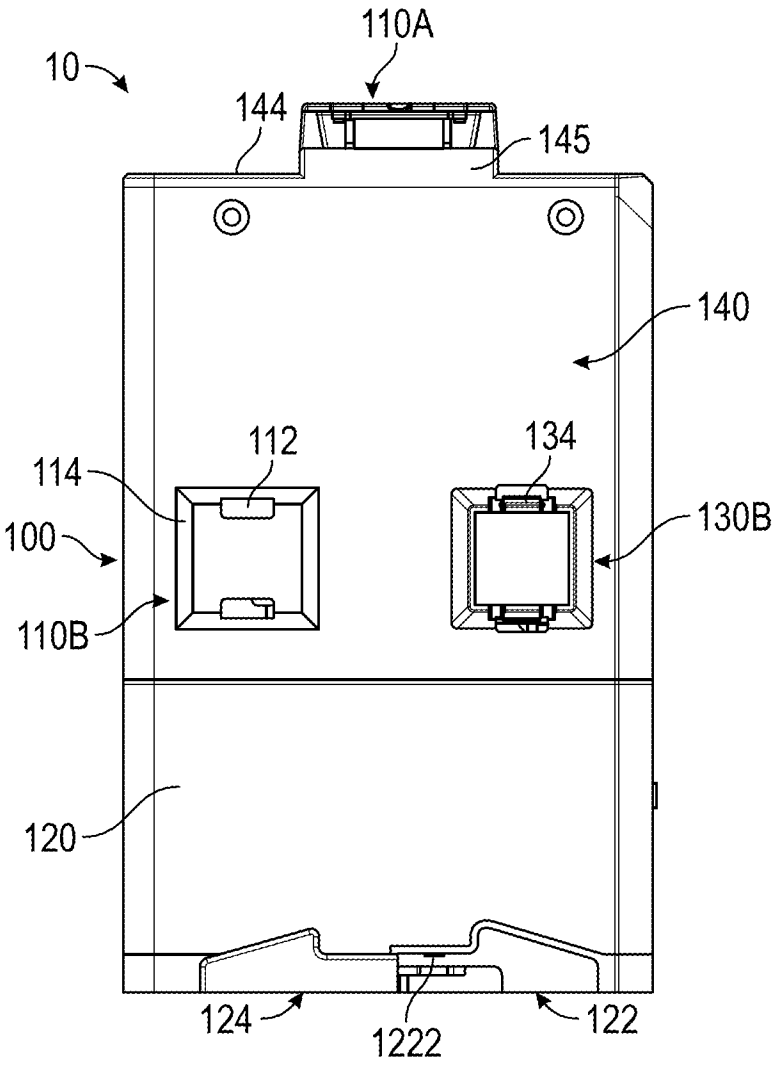
FIG. 2 is a second side view of the booster of FIG. 1A.
Figure 1C:
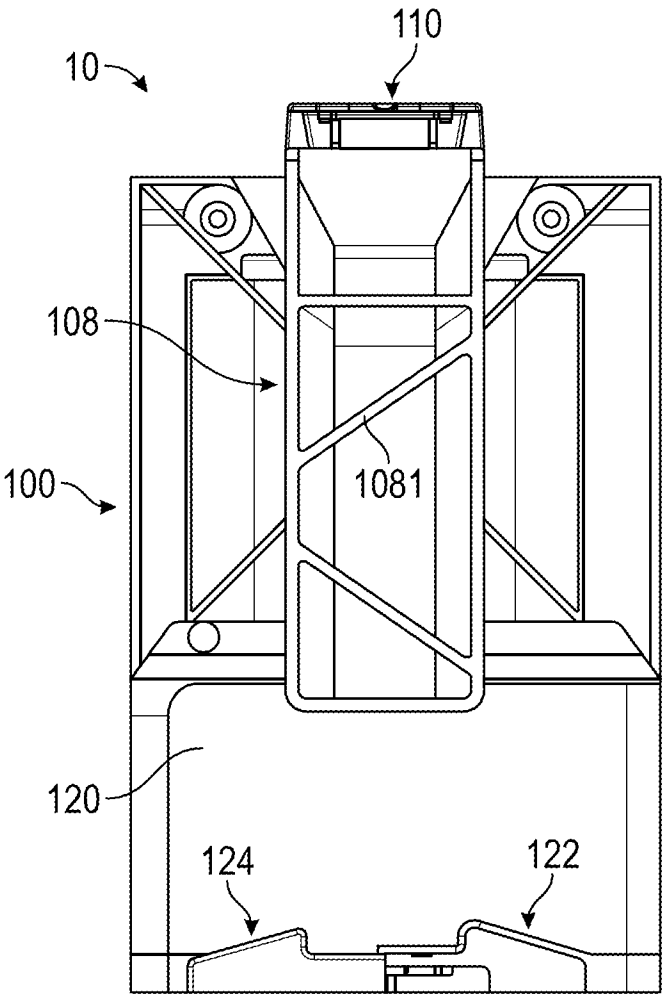
FIG. 1C is a first side view of the booster of FIG. 1A.
Figure 3:
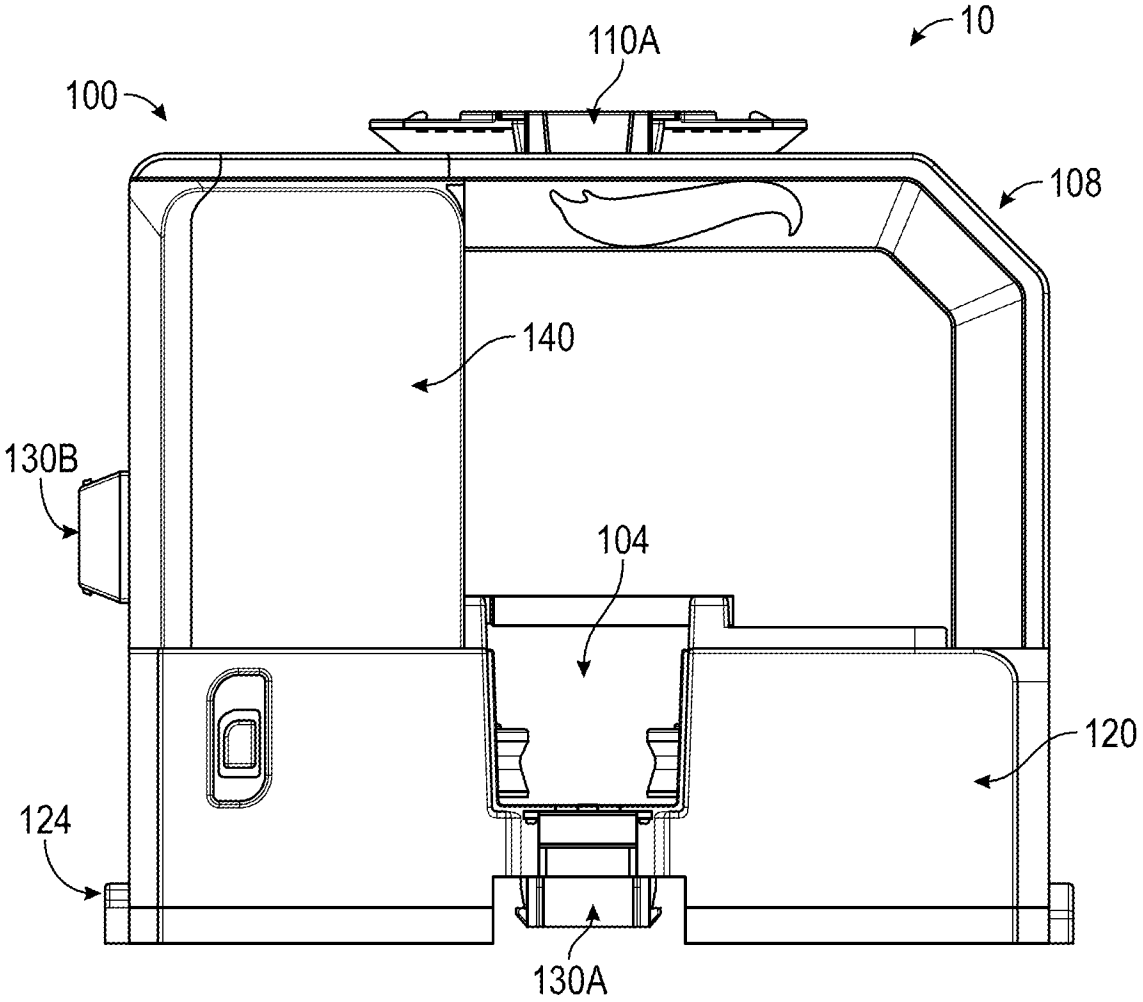
FIG. 3 is a back view of the booster of FIG. 1A.
Figure 4:
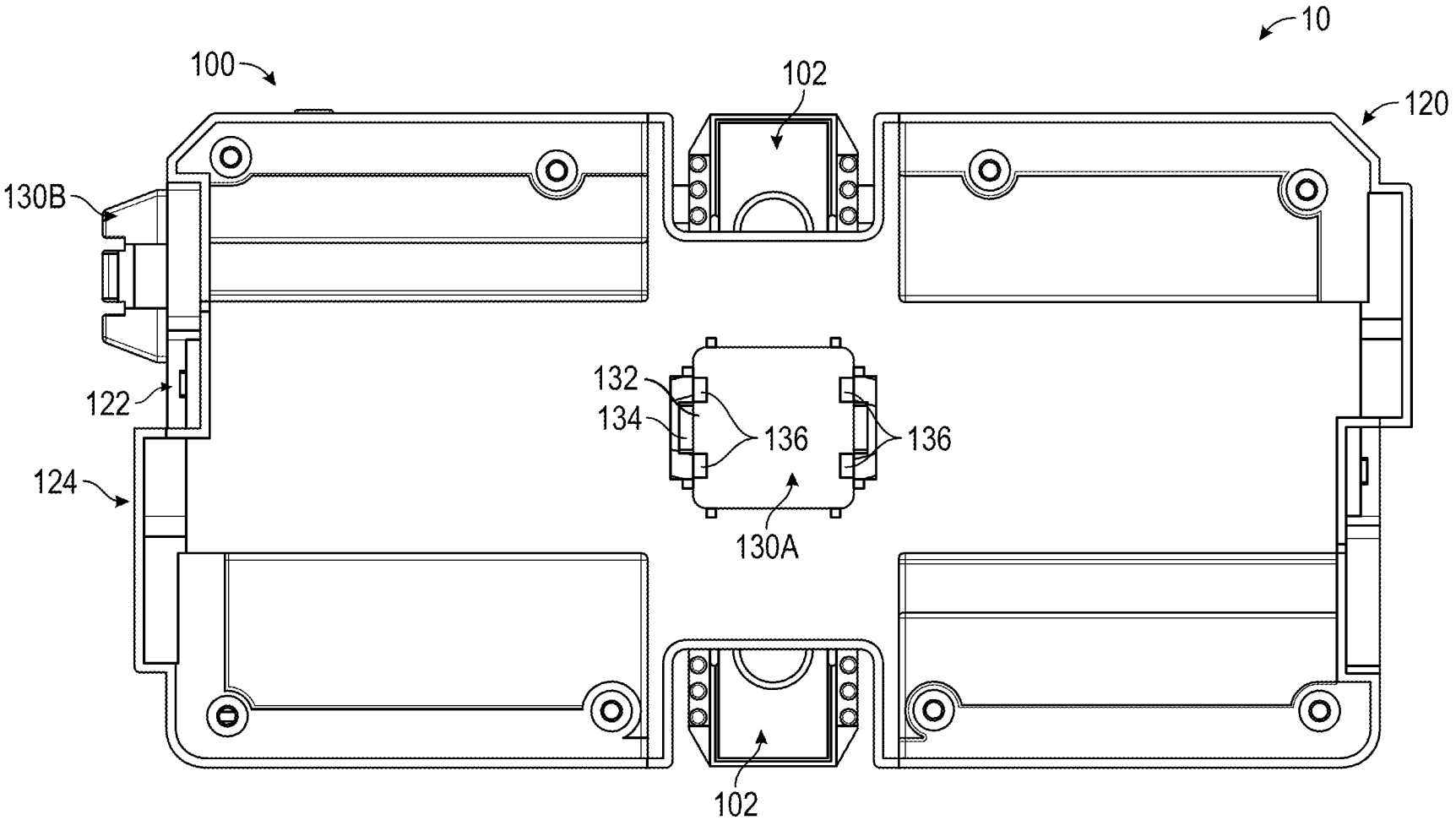
FIG. 4 is a bottom view of the booster of FIG. 1A.
Figure 5:
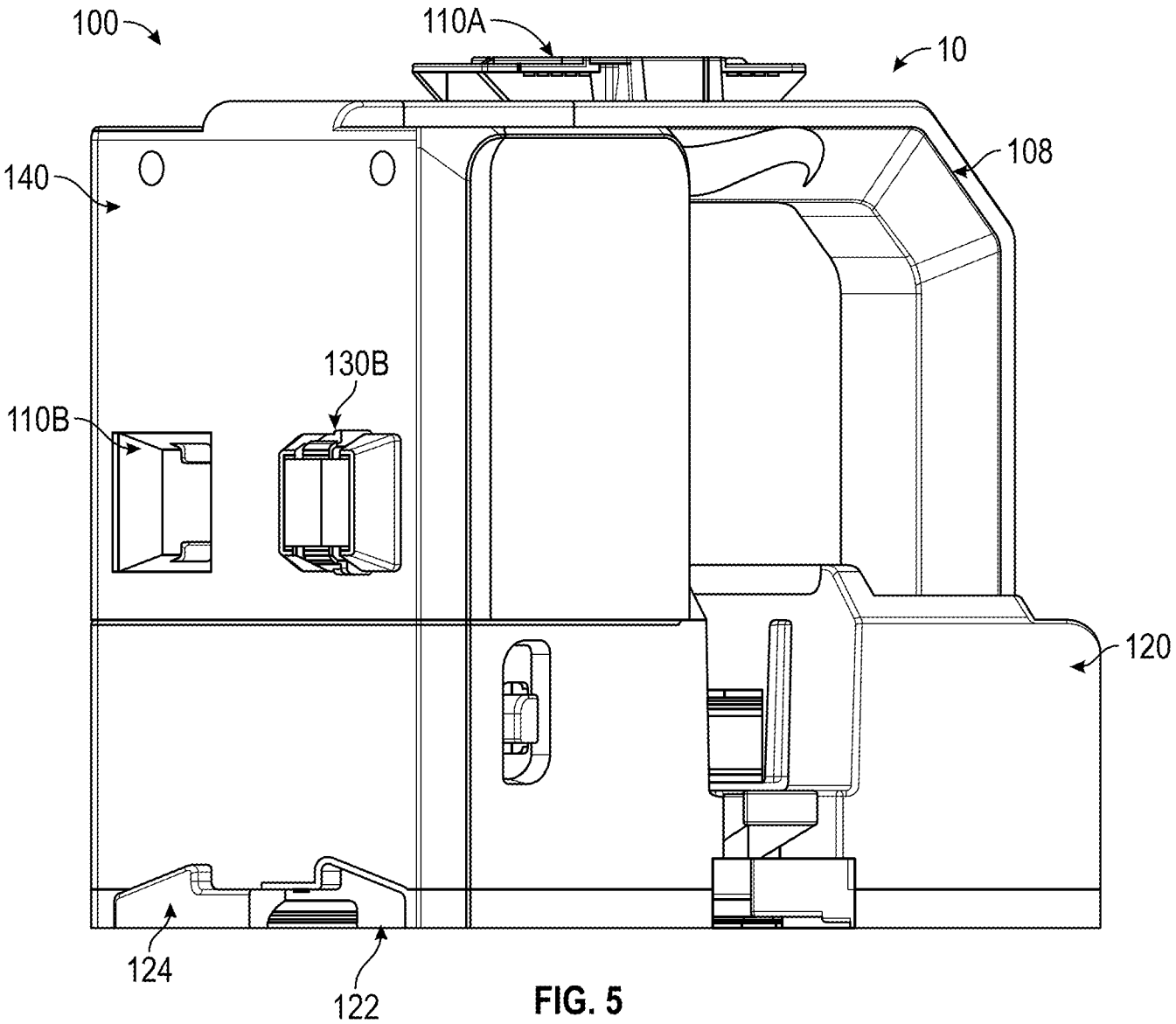
FIGS. 5 and 6 illustrate front and back perspective views, respectively, of the booster of FIG. 1A.
Figure 6:
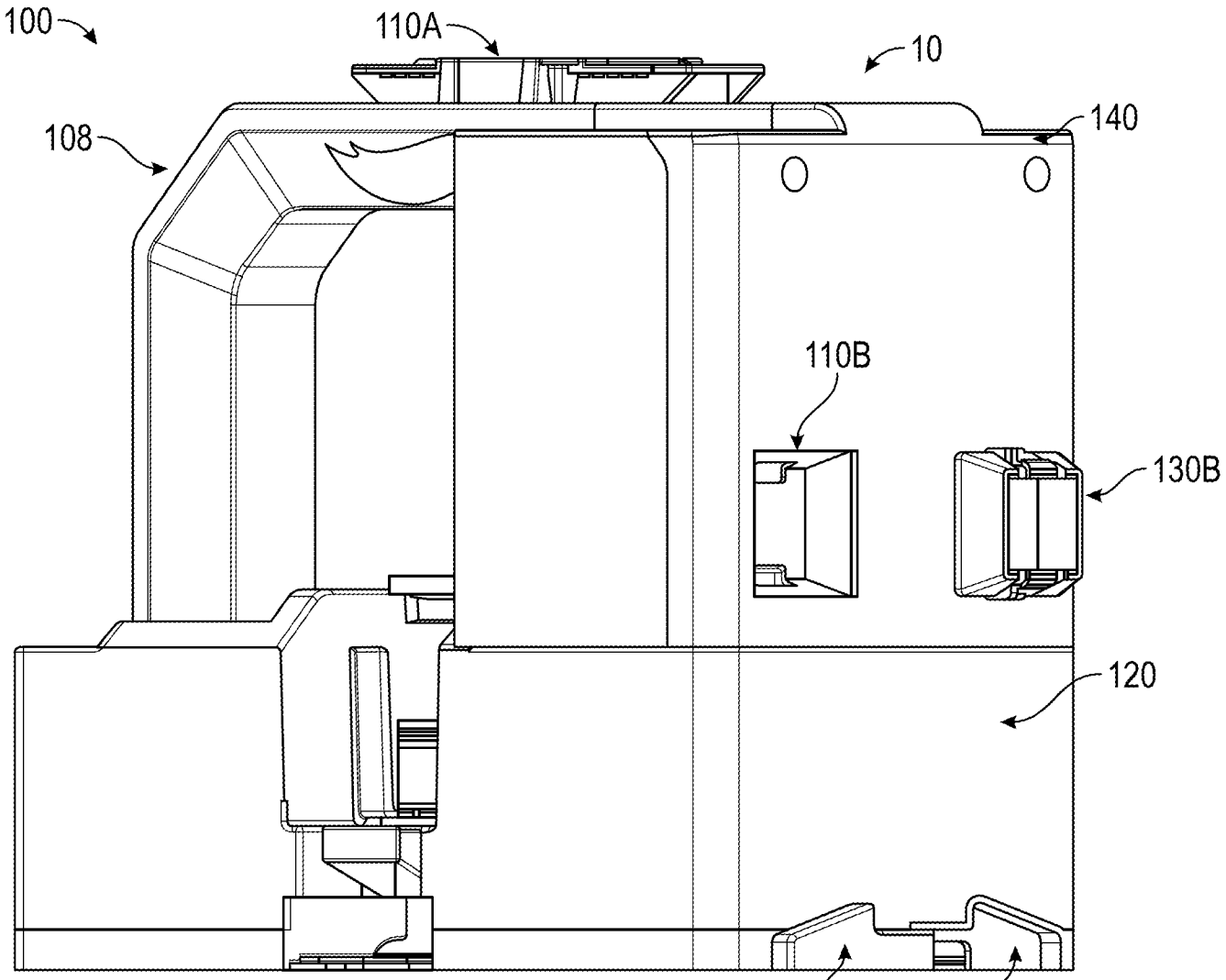
Figure 7:
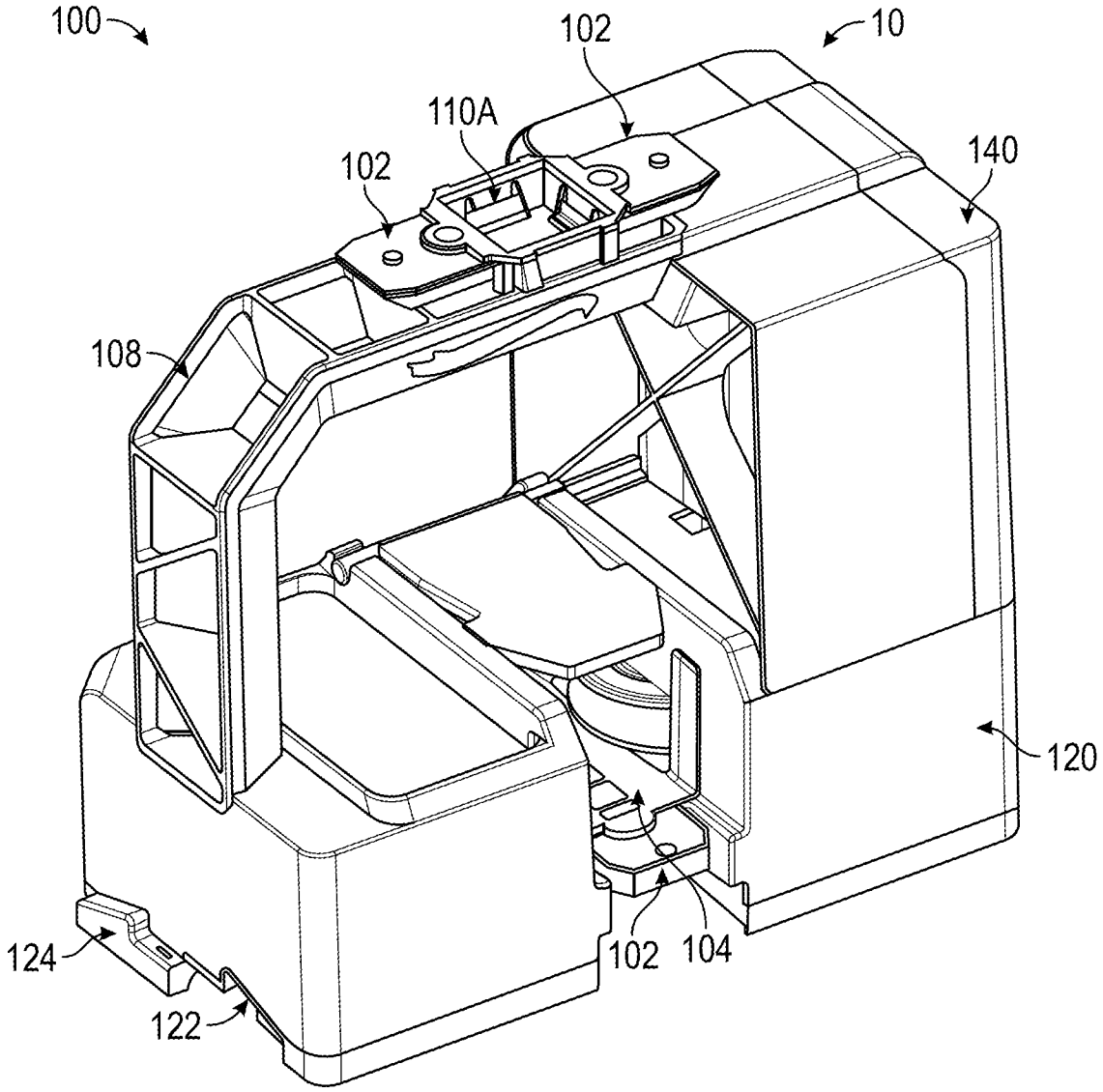
FIGS. 7 and 8 are top perspective views of the booster of FIG. 1A.

The receiving member 110 may be disposed on the battery compartment 140 and/or the frame 108. For example, the receiving member 110 may be disposed on a lateral surface of the battery compartment 140. Additionally, or alternatively, the receiving member 110 may be disposed on the frame 108. For example, the receiving member 110 may be disposed on an upper surface of the lateral portion 1082 of the frame 108. In some implementations, a first receiving member 110A may be disposed on an upper surface of the lateral portion 1082 of the frame 108 and a second receiving member 110B may be disposed on the battery compartment 140. As shown in FIG. 2, the second engagement member 130B and second receiving member 110B may be arranged next to one another on the battery compartment 140. For example, the second receiving member 110B may be laterally offset from the second engagement member 130B on the battery compartment 140. Alternatively, the second receiving member 110B may be disposed vertically offset from the second engagement member 130B. In some implementations, the second receiving member 110B and second engagement member 130B may be disposed at the base 120.

The receiving member 110 may include a recess which conforms to the shape of the engagement member 130. For example, sidewalls 114 of the second receiving member 110B may be defined by a recess that extends into the battery compartment 140. The sidewalls 114 of the receiving member 110 may include a groove 112 for receiving a tooth 134 of the engagement member 130. In some implementations, the sidewalls 114 may be angled or otherwise tapered with respect to the surface of the stackable booster 10. In some implementations, opposing sidewalls 114 each include a groove 112. In some implementations one or more sidewalls 114 each include a groove 112.

Referring to FIGS. 10B-10E, 10H, and 10I, a first engagement member 130A (not shown) of a first booster 10 may engage a first receiving member 110A of a second booster 10'. For example, the first booster 10 may be stacked on top of the second booster 10' such that the first engagement member 130A engages the first receiving member 110A of the second booster 10'. As shown in FIGS. 10B-10E, 10H, and 10I, the stacked boosters 10, 10' may be aligned or may have different orientations. That is, the boosters may be oriented at the same or different angles about the vertical axis. For example, the first booster 10 may be oriented at a first direction about a vertical axis and a second stacked booster 10' may be oriented at 0°, 90°, 180°, or 270° from the first direction about the vertical axis. While two boosters are shown, any number of boosters may be stacked.

Figure 10A:
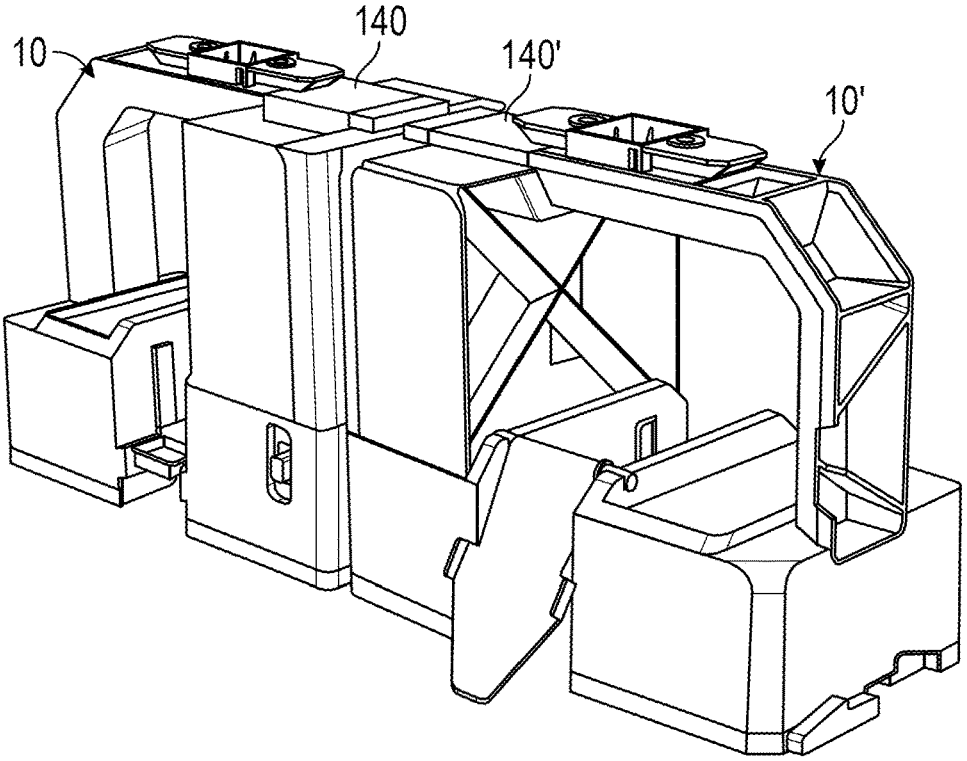
FIGS. 10A-10I are perspective views of different arrangements of a pair of boosters and/or track portions, according to one or more exemplary embodiments.
Figure 10B:
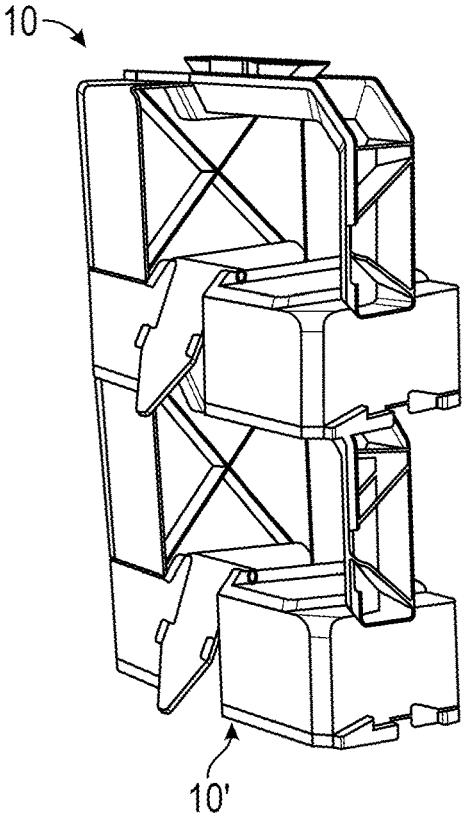
Figure 10C:
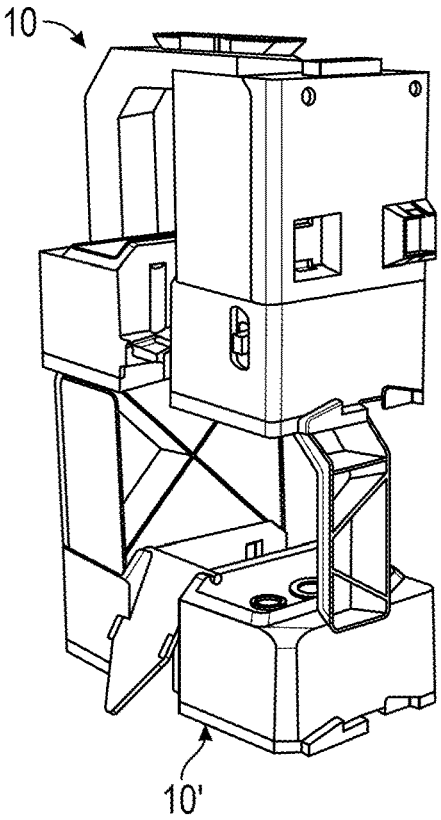

As one specific example, FIG. 10B shows vertically stacked boosters 10, 10' both oriented in the same direction, with the first booster 10 oriented in a first orientation and the second booster 10' oriented 0° from the first orientation. By comparison, FIG. 10C shows vertically stacked boosters 10, 10' oriented in the opposite orientations with the first booster 10 is oriented in a first orientation and the second booster 10' oriented in a second orientation, offset 180° from the first orientation.

Figure 10E:
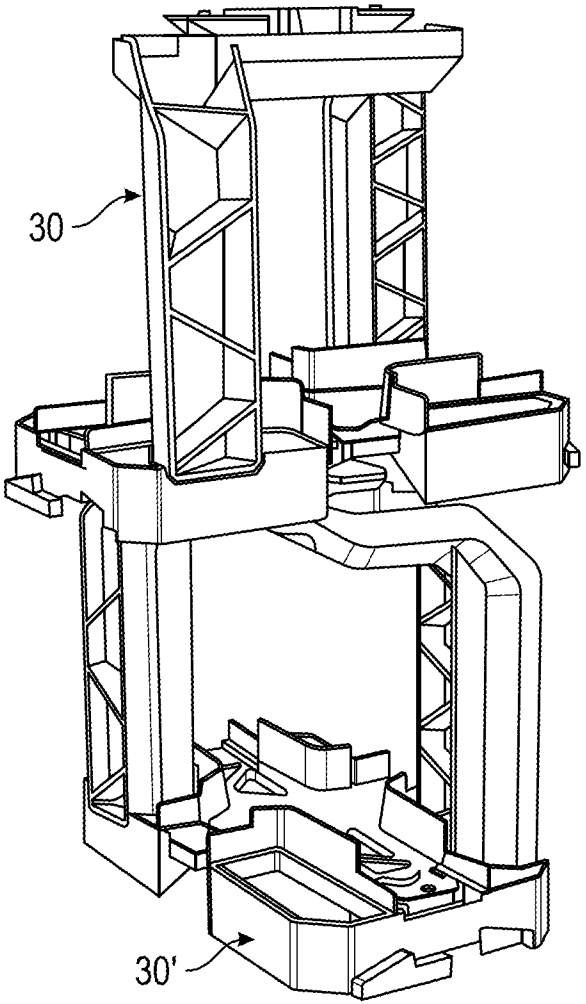
Figure 10D:
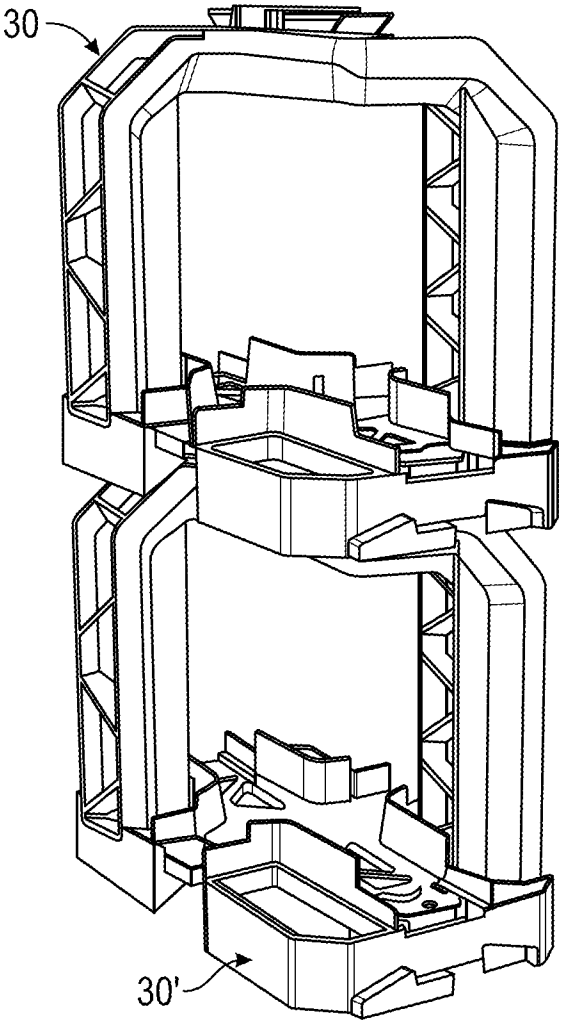

FIGS. 10D and 10E show vertically stacked track frames 30 having engagement members 130 and receiving members 110. The stacked track frames 30 may be oriented at the same or different angles about the vertical axis. For example, the first track frame 30 may be oriented at a first direction about a vertical axis and a second track frame 30' may be oriented at 0°, 90°, 180°, or 270° from the first direction about the vertical axis. While two frames are shown, any number of boosters may be stacked. For example, FIG. 10D shows vertically stacked track frames both oriented in the same orientation, with the top track frame 30 is oriented in a first orientation and the bottom track frame 30' oriented 0° or 180° from the first orientation. Meanwhile, FIG. 10E shows vertically stacked track frames 30, 30' oriented in the different orientations, with the top track frame 30 oriented in a first orientation and the second track frame 30' oriented in a second orientation, offset 90° from the first orientation.

Referring to FIG. 10A a battery compartment 140 of the first booster 10 is adjacent to a battery compartment 140' of the second booster 10'. In these positions, the first booster 10 and second boosters 10' may be coupled together via the second engagement member 130B engaging the second receiving member 110B a second engagement member 130B of a first booster 10 engages a second receiving member 110B of a second booster 10'.

Referring back to FIGS. 1A-8, in some implementation, the tooth 134 disposed on the finger 132 of an engagement member 130 may engage a groove 112 of the receiving member 110. For example, when the engagement member 130 engages the receiving member 110, the sidewall 138 of the engagement member 130 protrudes into the receiving member 110 until the tooth 134 of the finger 132 engages the groove 112 of the receiving member 110. In a coupled state, the sidewall 138 of the engagement member 130 may contact a sidewall 114 of the receiving member 110. To de-couple an engagement member 130 from a receiving member 110, the engagement member 130 may be pulled from the receiving member 110. The finger 132 may resiliently bend away from the receiving member 110 until the tooth 134 exits the groove 112.

In some implementations, the base 120 may include a tab 124 and slot 122. For example, the tab 124 and slot 122 may be disposed at a lateral side 123, 125 of the base 120. The tab 124 extends laterally from the base 120 of the stackable booster 10 or frame 30. The slot 122 may be a recess that extends into the base 120 and may be shaped to conform to the tab 124. The slot 122 may be configured to receive the tab 124. In some implementations, the slot 122 may include a protrusion 1222 and the tab 124 may include a notch 1242. When the slot 122 receives the tab 124, the protrusion 1222 of the slot 122 may engage the notch 1242 of the tab 124. In some implementations, tabs 124 and slots 122 are disposed on two lateral sides of the base 120. For example, a first tab 124 and first slot 122 may be disposed on battery compartment 140 side surface 125 of the base 120 and a second tab 124 and second slot 122 may be disposed on the frame 108 side surface 123 of the base 120.

Figure 10F:
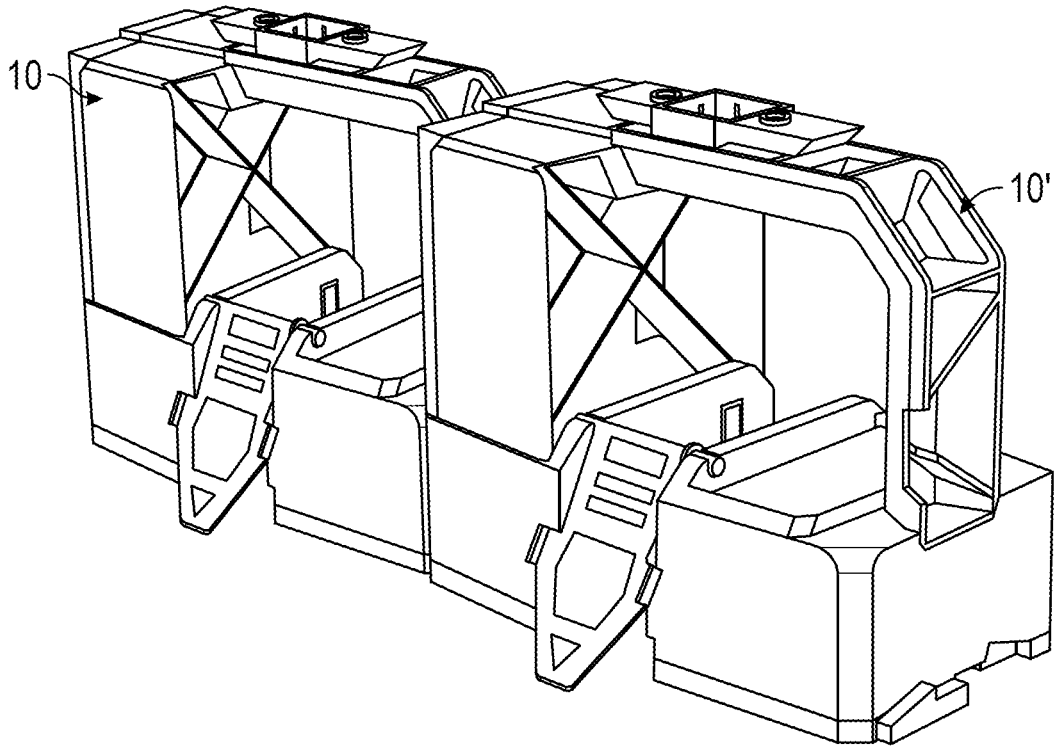
Figure 10G:
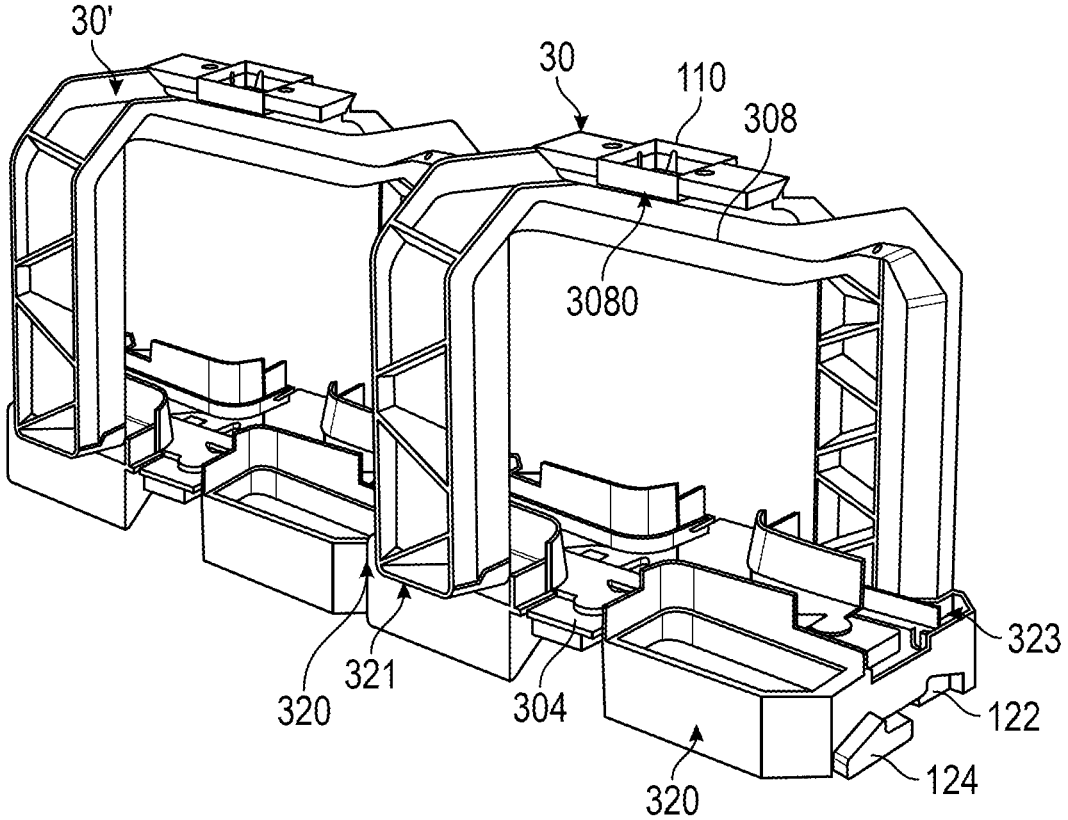
Figure 10I:
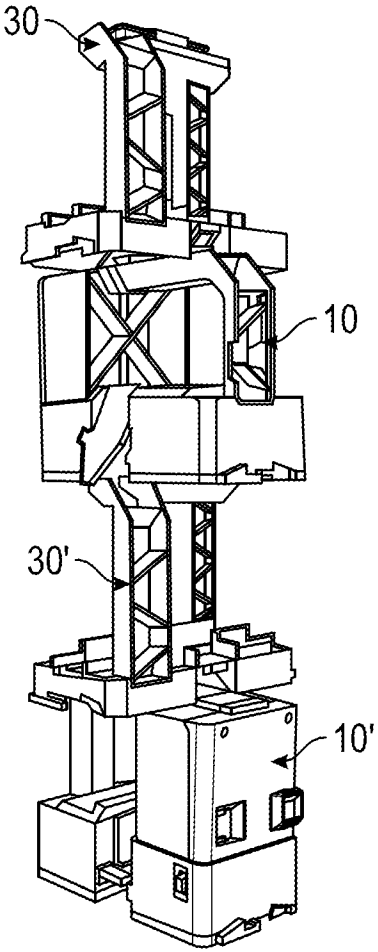
Figure 10H:
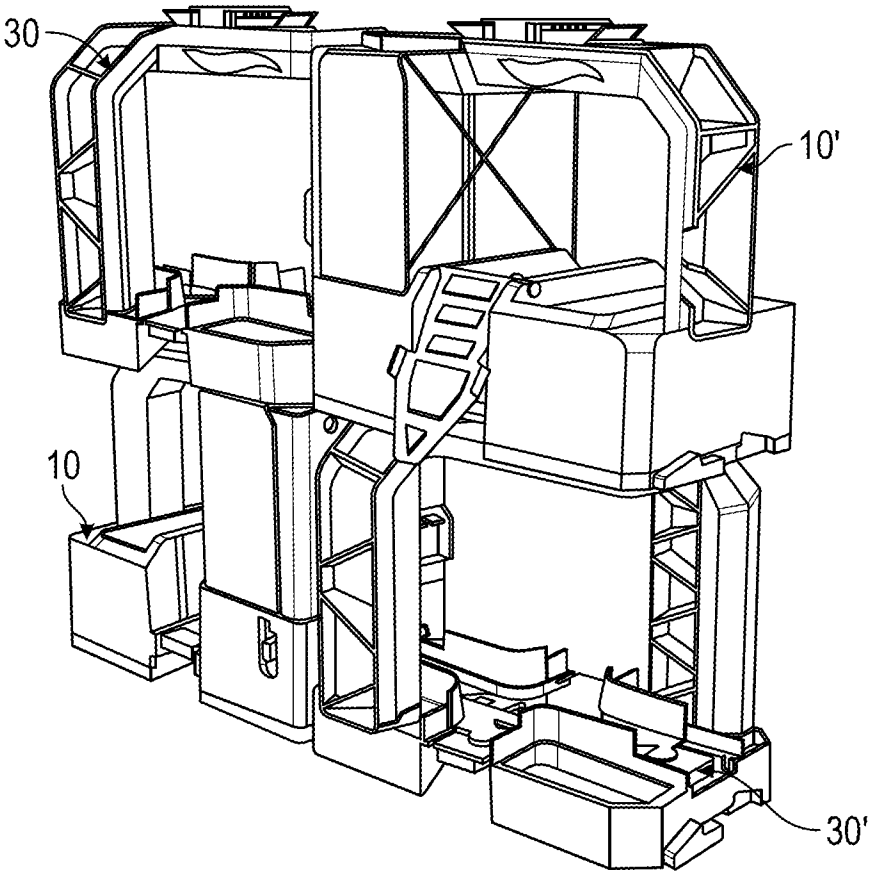

As is shown in FIGS. 10A and 10F, the tab 124 of a first stackable booster 10 may engage a slot 122 of a second booster 10, thereby removably coupling the first booster 10 to a second booster 10'. The engagement of the notch 1242 by the protrusion 1222 resists removal of the tab 124 from the slot 122 when engaged. As shown in FIGS. 10A and 10F, the tabs 124 and slots 122 of the first and second boosters may engage one another when the boosters 10, 10' are arranged battery compartment 140 side surface 125 to battery compartment 140' side surface 125' of the base 120', or battery compartment 140 side surface 125 to frame 108' side surface 123' of the base 120', or frame 108 side surface 123 to frame 108' side surface 123' of the base 120'. That is, a tab 124 disposed at a battery compartment 140 side surface 125 of the base 120 of a first booster 10 may engage a slot 122' disposed at a battery compartment 140' side surface 125' of a base 120' of a second booster 10' or a slot 122' disposed at a frame 108 side surface 123' of a base 120' of the second booster 10'. Additionally, the tab 124 and slot 122 may engage one another when the vertical portions 1086 of the boosters are aligned. That is a tab 124 disposed at a frame 108 side surface 123 of the base 120 of a first booster 10 may engage a slot 122' disposed at a frame 108' side surface 125' of the base 120' of a second booster 10'.

In some implementations, a tab 124' disposed at the second booster 10' may engage a slot 122 at the first booster 10 and a tab 124 disposed at the first booster may engage a slot 122' of the second booster 10'. The boosters may be arranged battery compartment 140 side surface 125 to battery compartment 140' side surface 125' of the base 120' (e.g., FIG. 10A), or battery compartment 140 side surface 125 to frame 108' side surface 123' of the base 120 (e.g., FIG. 10F), or frame 108 side surface 123 to frame 108' side 123' of the base 120' (not shown). While two boosters are described as being laterally coupled, any number of boosters and/or track frames may be laterally coupled.

FIGS. 9A-9D depict a stackable booster assembly 20 according to another embodiment. The booster 20 is similar to the embodiment shown in FIGS. 1A-8. Accordingly, the same reference numbers are used to refer to the same parts. For example, the stackable booster 20 includes a housing 100, a base 120, a battery compartment 140, and a frame 108. However, in contrast with booster 10, booster 20 includes an engagement member 230 that may be a tongue and a receiving member 210 that may be a groove.

Groove 210 may be disposed on along the battery compartment 140 side 125 of the booster 20. Additionally, or alternatively, a groove 210 may extend along a bottom 128 of the base 120. For example, a groove 210 may extend along a longitudinal axis and/or a lateral axis of the bottom 128 of the base 120. That is the groove 210 may extend along the base 120 perpendicular to the track portion 104 and/or parallel to the track portion 104. The groove 210 may be configured to engage the tongue 230. For example, a tongue 230 of a first booster 20 may slideably engage the groove 210 of a second booster 20'. Through the tongue 230 and grooves 210 arrangement, the second booster 20' may be removably coupled to the first booster 20 in a variety of orientations and arrangements, such as those described above in connection with FIGS. 10B-10I.

Moreover, although receiving members 110, 210, engagement members 130, 230, slot 122, and tab 124 have been discussed with respect to boosters 10 and 20, these elements may also be applied to a track frame. For example, referring to FIGS. 10D, 10E, and 10G, the track frame 30 may include a base 320, a track portion 304 disposed in the base 320, and frame 308 extending from a first corner 321 of the base over the track portion and back down to a second corner 323 of the base. For example, the second corner of the base may be diagonal from the first corner of the base. A receiving member 110 may be disposed on top 3080 of the frame 308 of the track frame 30, and an engagement member 130 (not shown) may be disposed at the bottom of the base. Tabs 124 and slots 122 may be disposed at the lateral sides of the track frame. Accordingly, the receiving members receiving member, engagement member, slots, and tabs of the track frame 30 provide for stacking the track frame in a variety of orientations as discussed above with respect to the boosters 10, 20. Because the receiving member, engagement member, slots, and tabs correspond the to the receiving members 110, 210, engagement members 130, 230, slots 122, and tabs 124 of the boosters 10, 20, the track frames 30 and boosters 10, 20 may be stacked together in a number of arrangements. See FIGS. 10A-10I.

Figure 11:
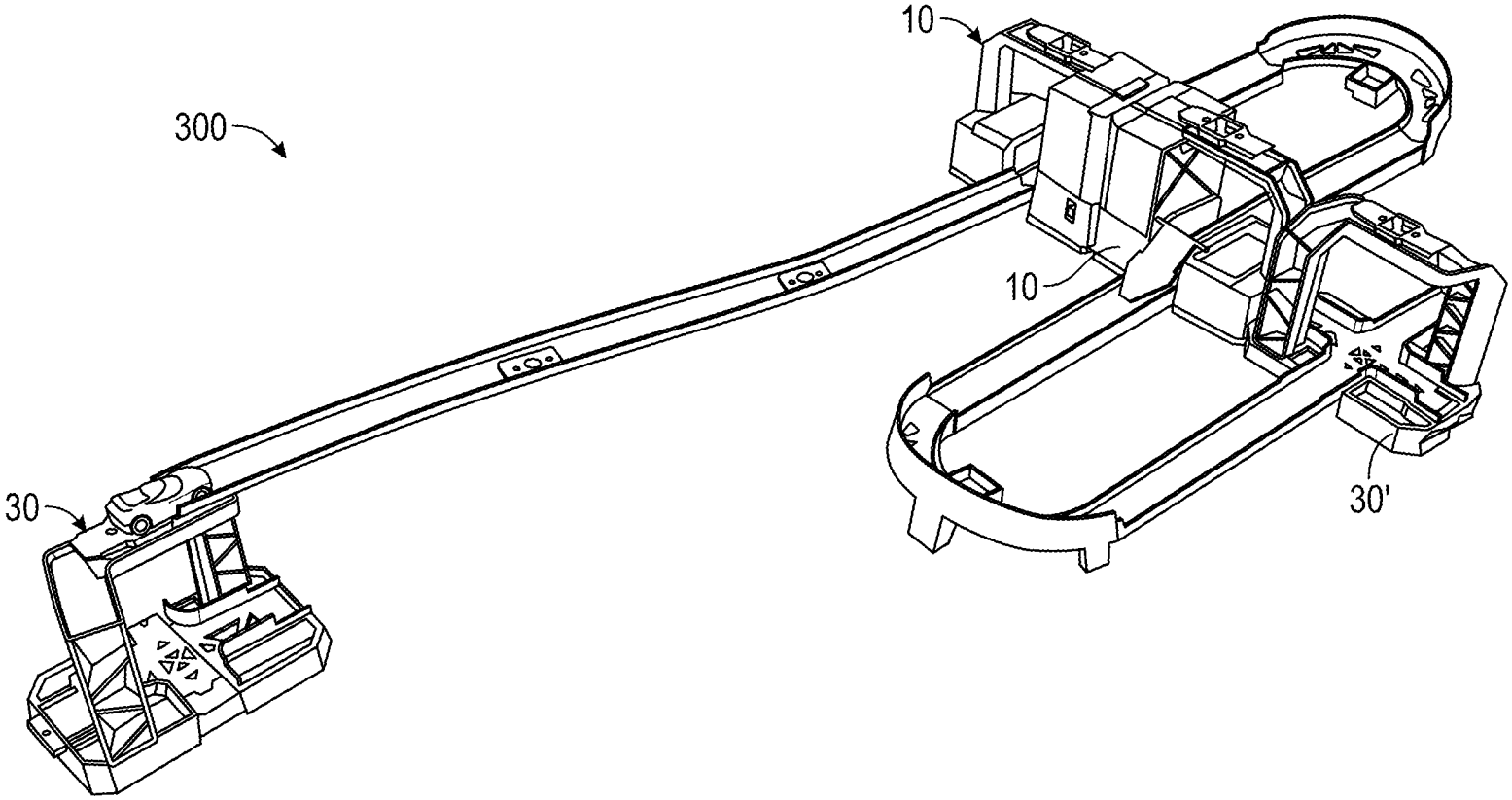
FIGS. 11-18 are perspective views of different example racetrack layouts in which the boosters and/or track portions presented herein may be included.
Figure 12:
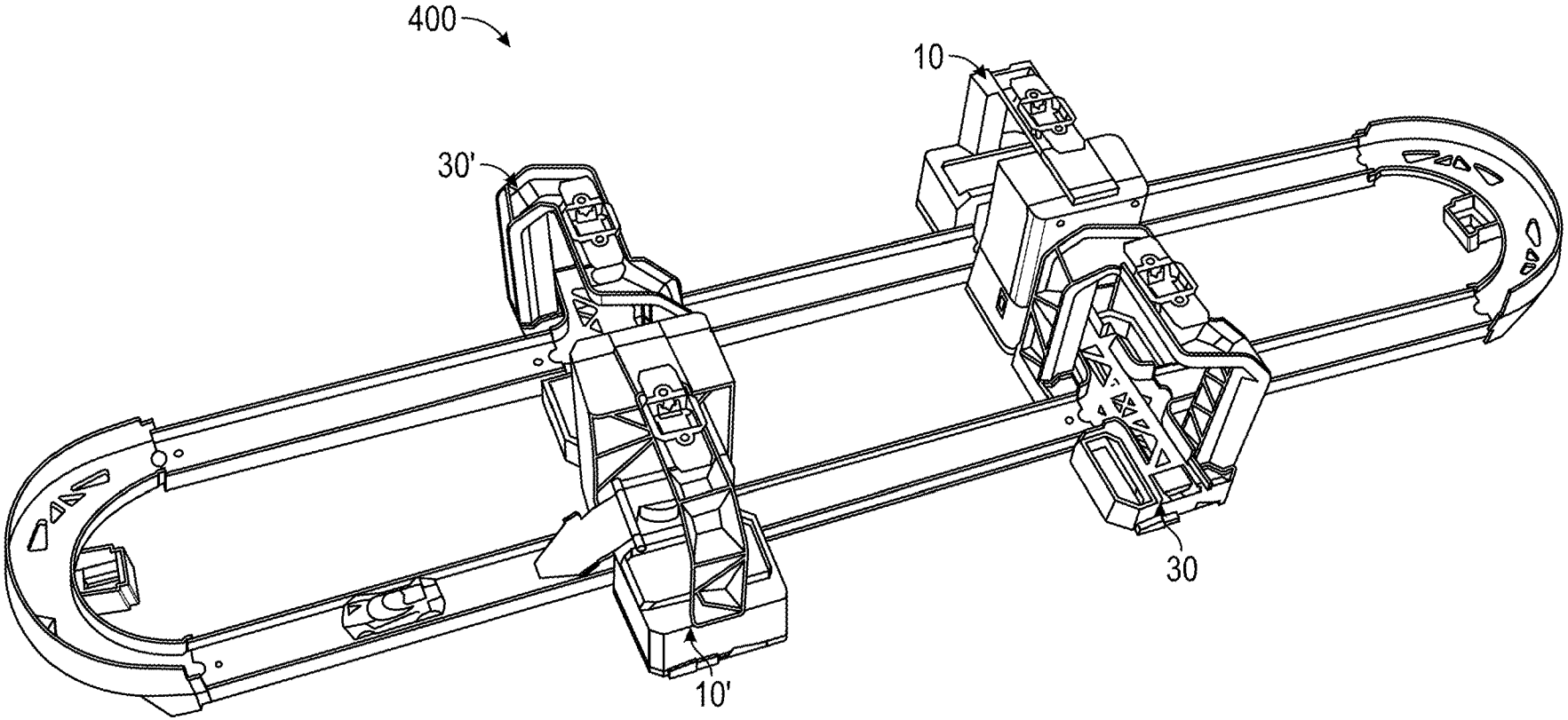
Figure 13:
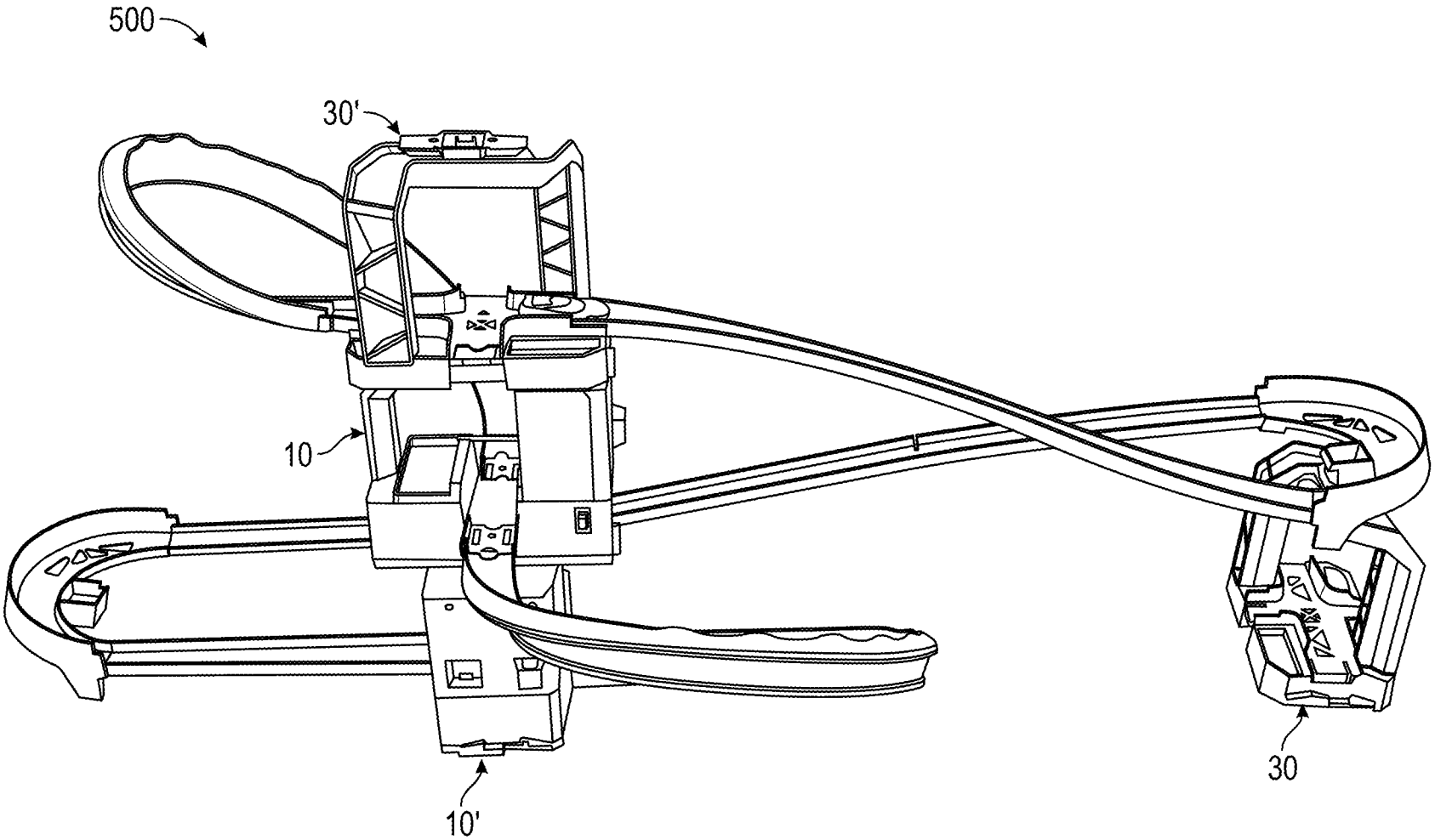
Figure 14:
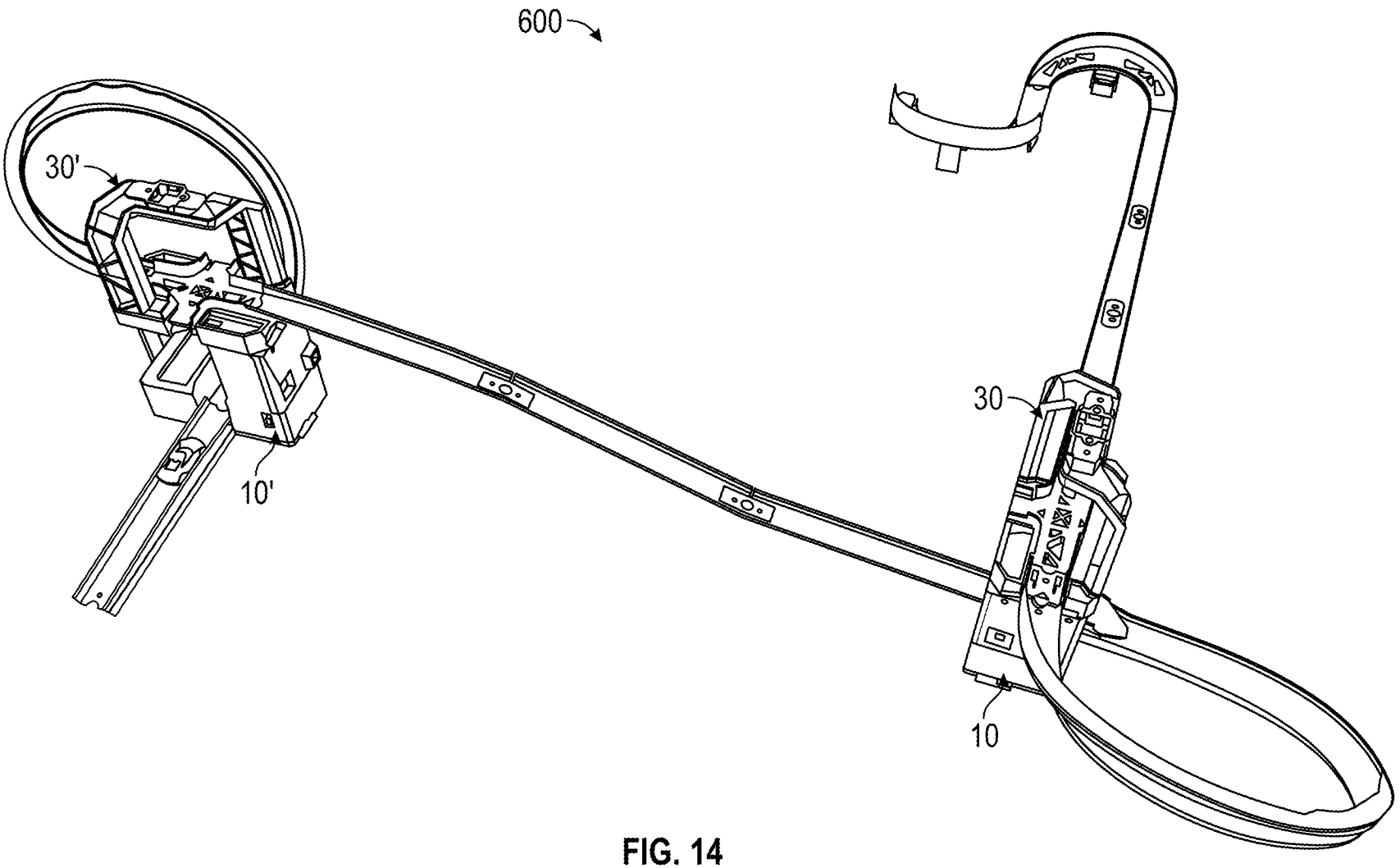

Referring to FIGS. 11-18, the stackable boosters and track frames disclosed herein may be coupled together in a variety of arrangements to configure various track layouts or raceways. For example, FIG. 11 shows two boosters and one track frame stacked horizontally in an open path (e.g., start to finish) layout 300. FIG. 12 is a closed loop layout 400 and includes a first booster and first track frame stacked horizontally and a second booster and second track frame stacked horizontally. FIG. 13 is a closed loop layout 500 with elevated tracks. The tracks are supported by two boosters vertically stacked and oriented 90° from each other. A track frame is vertically stacked onto the two boosters. A second track frame supports a portion of the track separate from the vertically stacked boosters and frame. FIG. 14 shows an open path layout 600 with elevated stunt turns and two separated stacks of track frames on top of boosters. The stacks oriented perpendicular to one another and are connected via a track.

Figure 15:
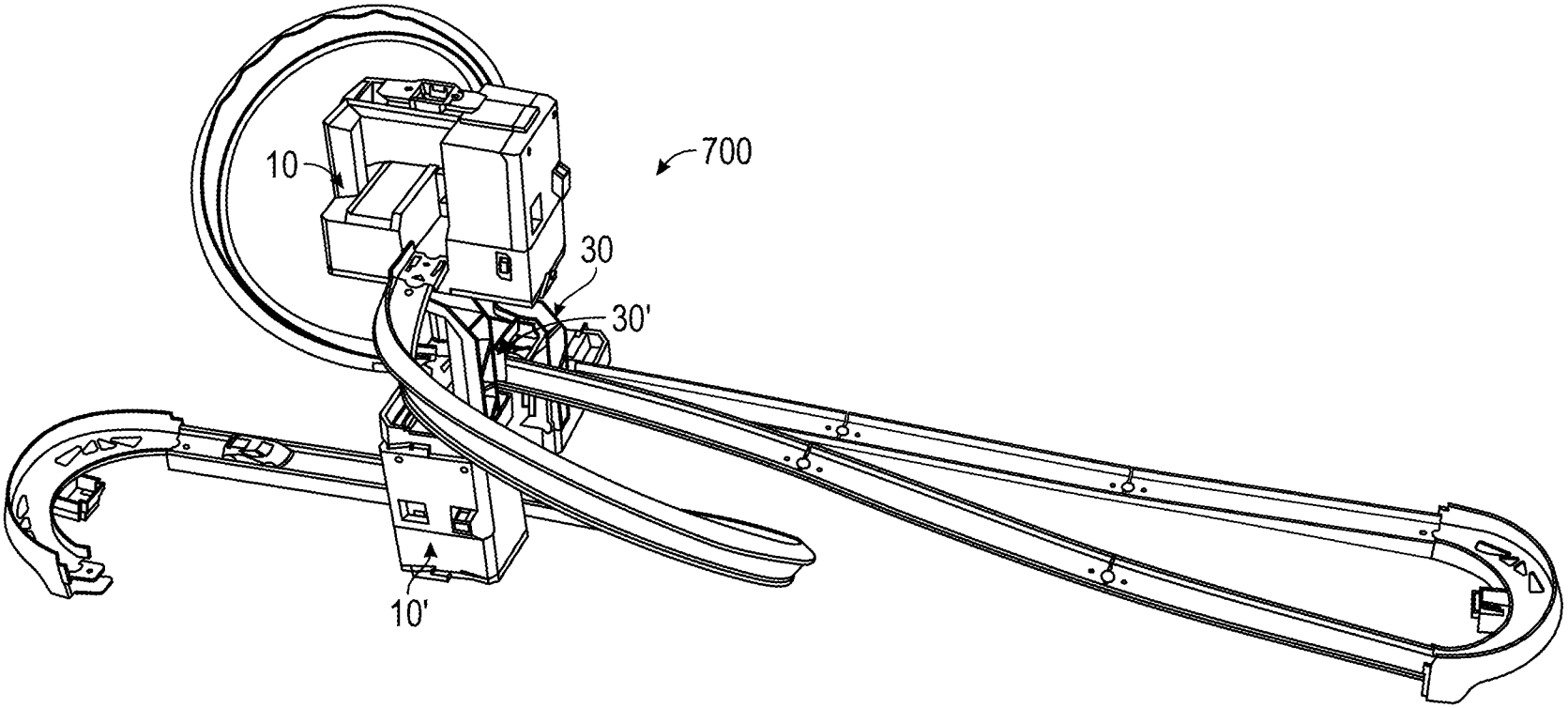
Figure 16:
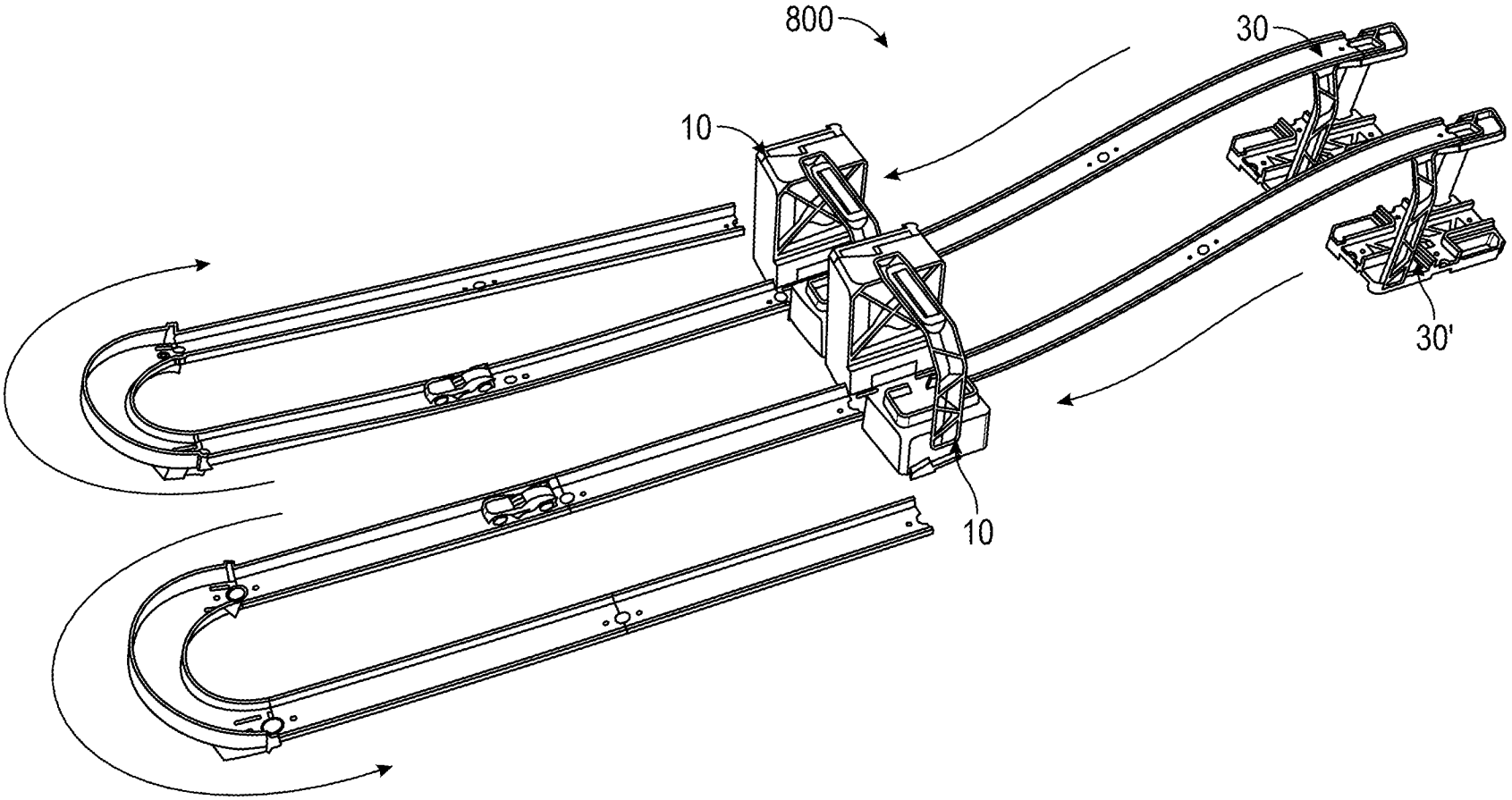
Figure 17:
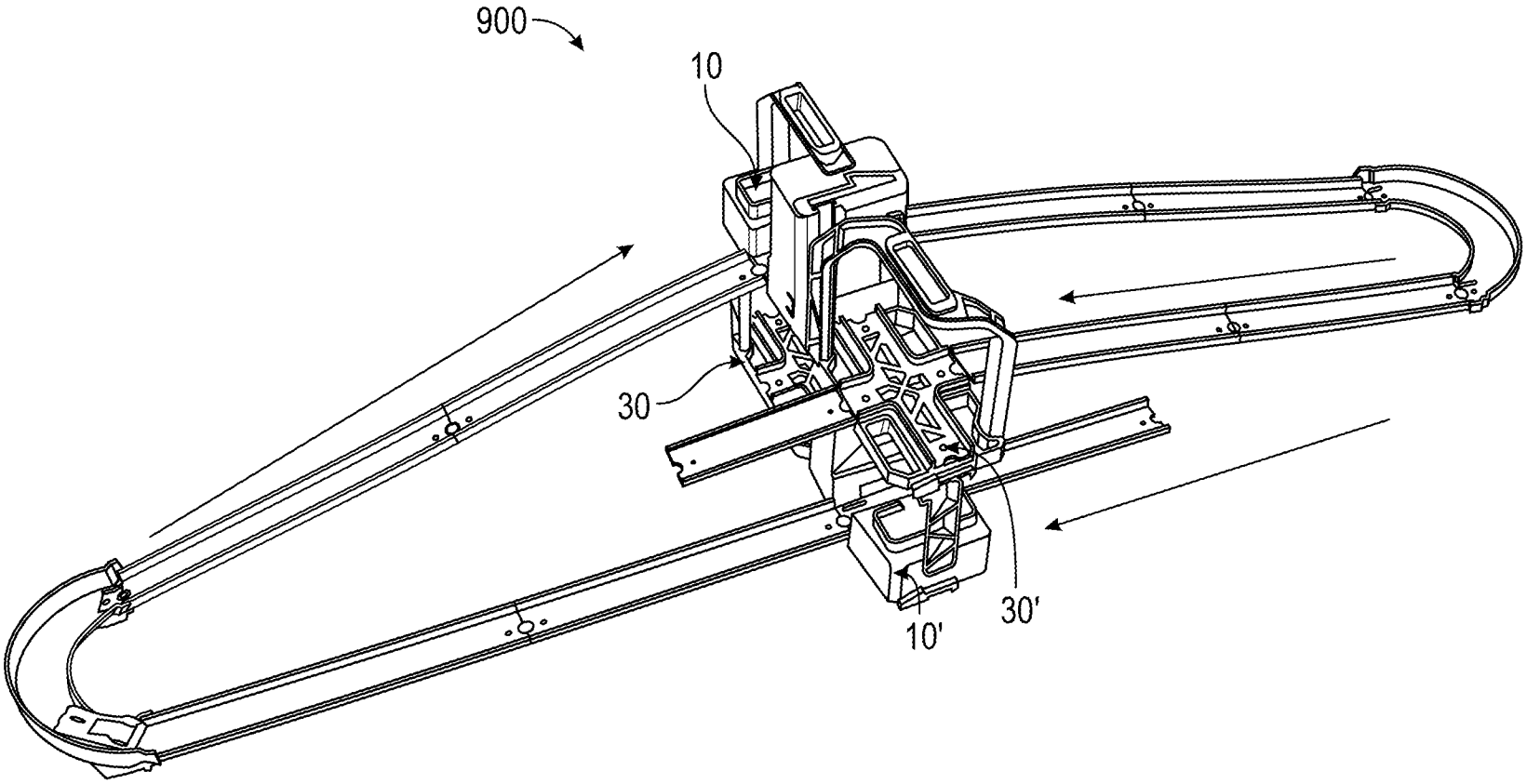
Figure 18:
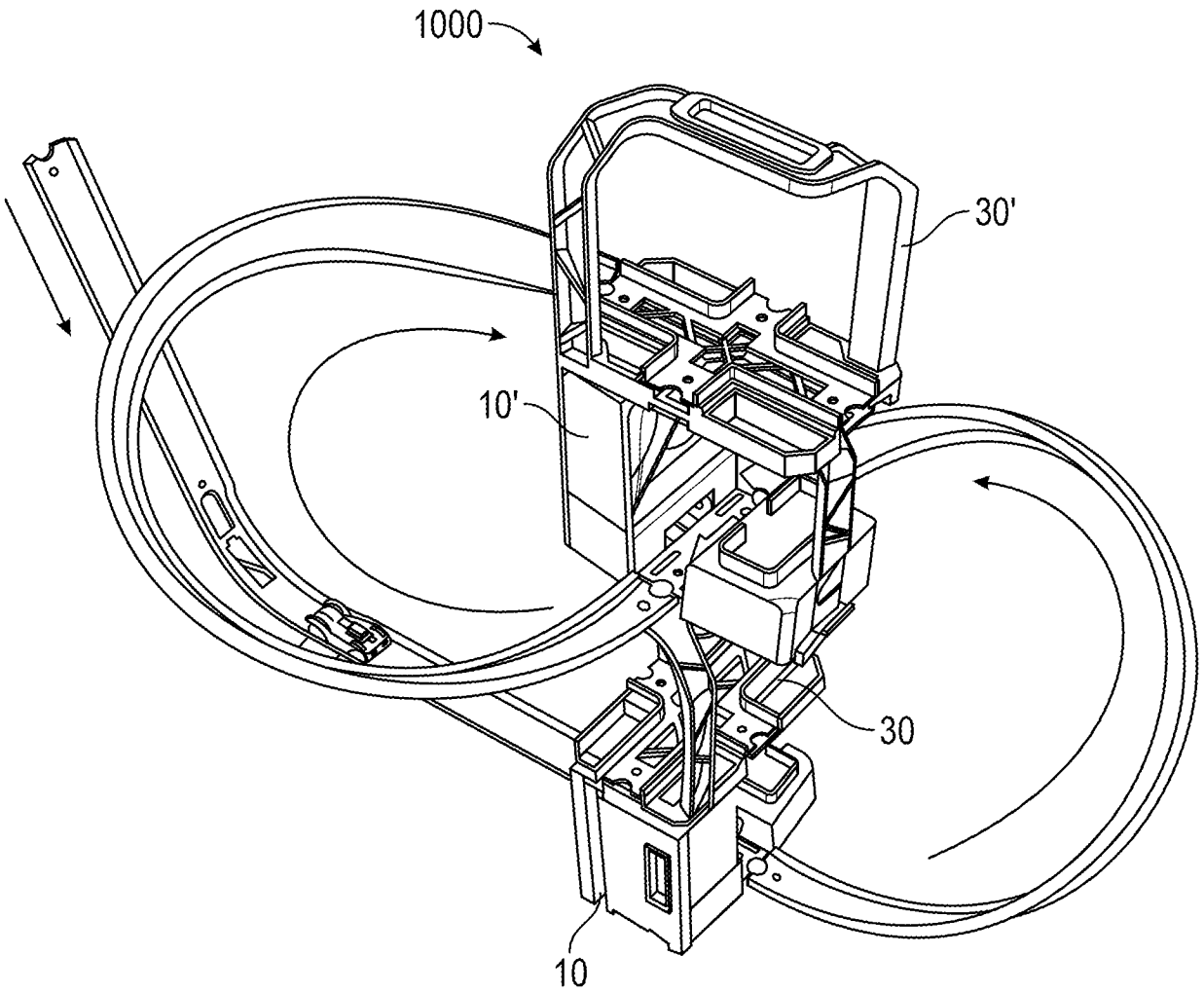

As still further examples, FIG. 15 illustrates an open path layout 700 with elevated stunt turns, a first booster supporting a first track frame stacked vertically. A second booster is vertically stacked on the first track frame and oriented perpendicularly to the first booster and first track frame. A second track frame is horizontally stacked onto the first booster. A track is further connected to the first and second boosters and first and second track frames. FIG. 16 is an open path, dual track layout 800 with elevated track. The tracks are elevated by a set of track frames. The two tracks are coupled together via a horizontally stacked set of boosters. FIG. 17 is an open path with elevated tracks and a first vertical stack and second vertical stack. The first vertical stack includes a first track frame vertically stacked on a first booster. The second vertical stack includes a second booster vertically stacked on a second track frame. The two vertical stacks are further horizontally stacked. FIG. 18 shows an open path layout 1000 with elevated stunt turns and a vertical stack of booster and track frames. The vertical stack includes a first track frame stacked on a first booster, the first booster is stacked on a second track frame, the second track frame is stacked on a second booster. The first booster and track frame are perpendicular to the second booster and track frame.

Figure 19A:
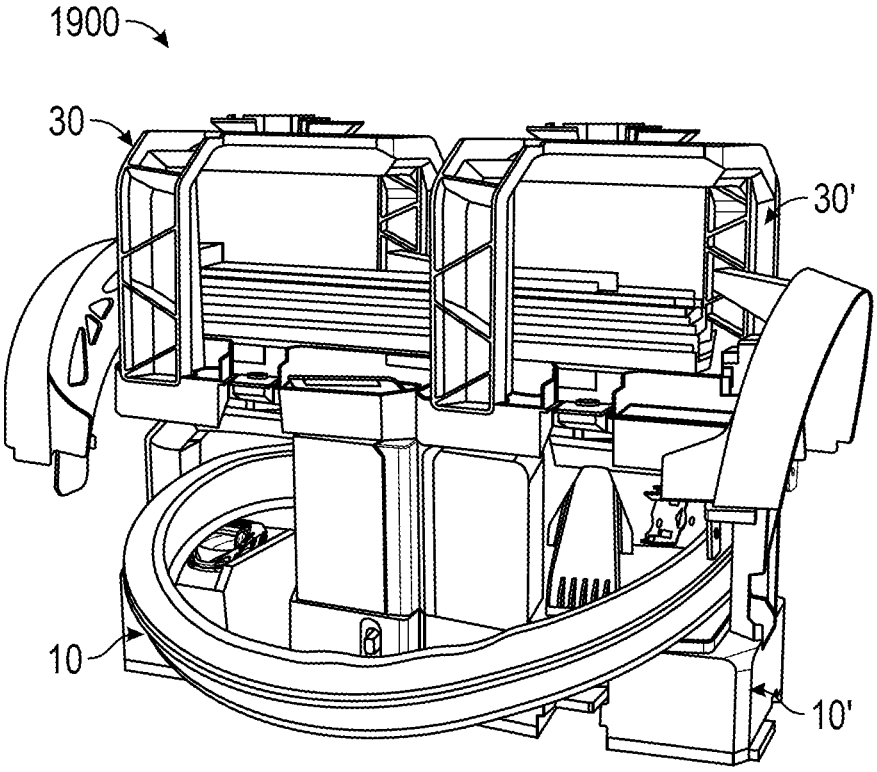
FIGS. 19A-19C are perspective views of example storage/transport configurations in which the track portions and boosters presented herein may be arranged.
Figure 19B:
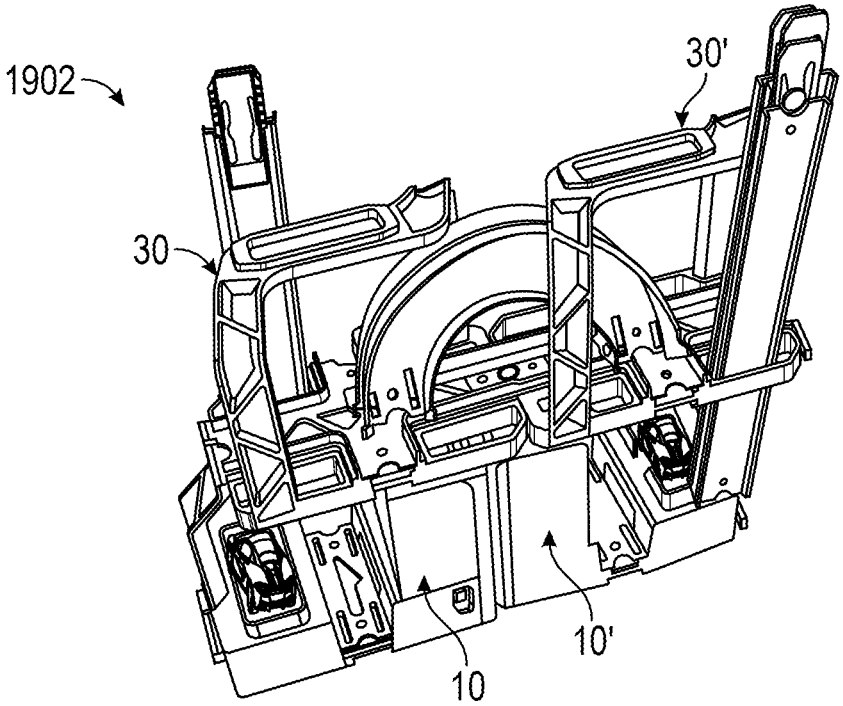
Figure 19C:
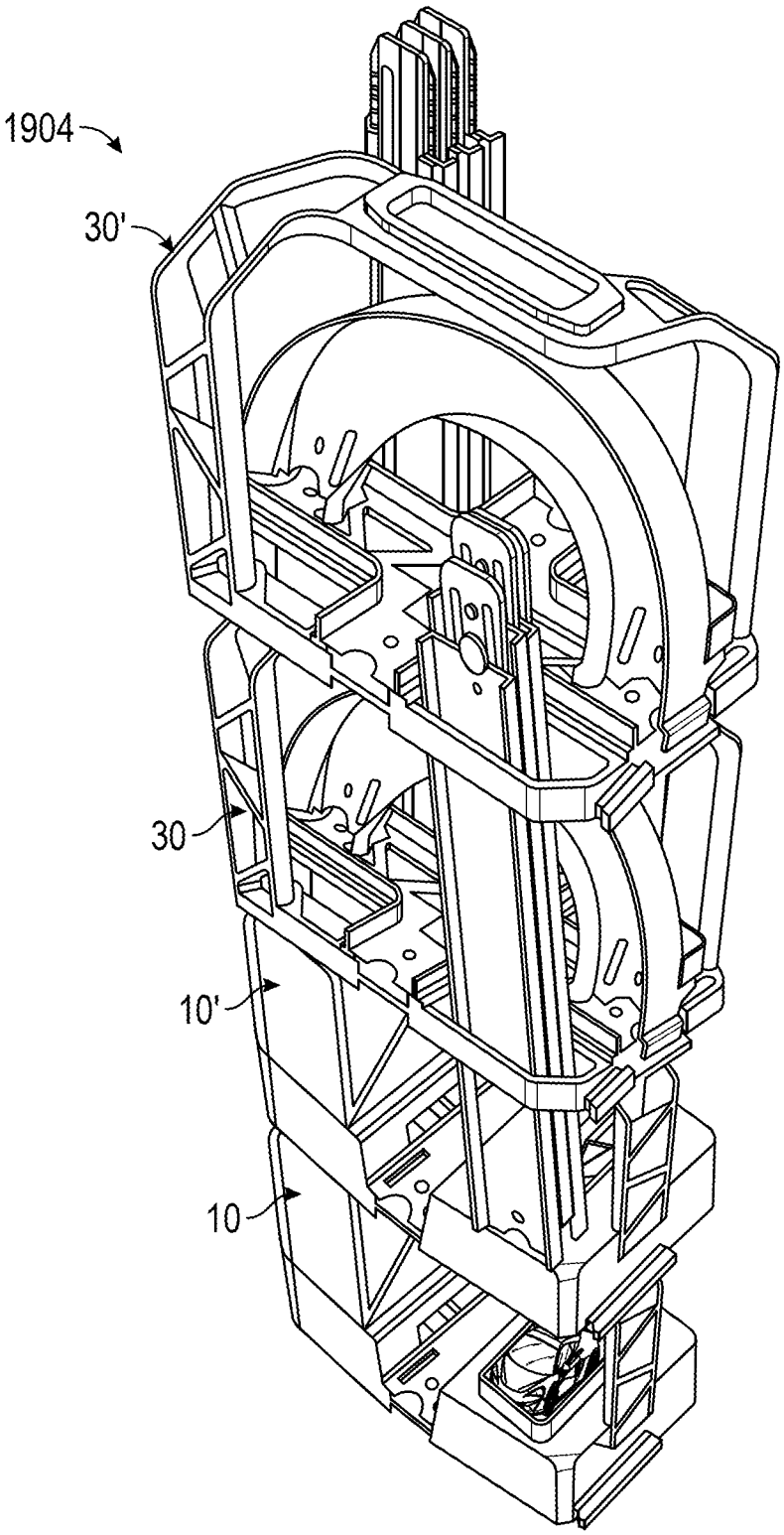

Referring to FIGS. 19A-19C, the stackable boosters and track frames as disclosed herein may be coupled together in a variety of arrangements for storing track portions and/or packaging track portions. FIG. 19A is a first storage configuration 1900. In this configuration, the track frames are laterally attached, the boosters are laterally attached, and the laterally attached track frames are stacked vertically atop the boosters. Straight track portions are horizontally disposed in the track frames and curved portions of the tracks are disposed in the boosters and on outer lateral sides of the track portions. FIG. 19B is a second storage configuration 1902. In this configuration, the track frames and boosters are arranged in a similar manner to those in first storage configuration 1900 in 19A. However, the straight track portions are now disposed in through holes at the corners of the track frames and supported by the base of the boosters. Curved track portions are horizontally disposed within the track frames. FIG. 19C is a third storage configuration 1904. In this configuration the first and second boosters are vertically stacked and the first and second track frames are further stacked on the boosters. The straight track portions are disposed in through holes at the corners of the track frames and supported by the base of one of the boosters. Curved track portions are horizontally disposed within the track frames.

While the invention has been illustrated and described in detail and with reference to specific embodiments thereof, it is nevertheless not intended to be limited to the details shown, since it will be apparent that various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

It is also to be understood that the track frame and/or booster described herein, or portions thereof may be fabricated from any suitable material or combination of materials, such as plastic, foamed plastic, wood, cardboard, pressed paper, metal, supple natural or synthetic materials including, but not limited to, cotton, elastomers, polyester, plastic, rubber, derivatives thereof, and combinations thereof. Suitable plastics may include high-density polyethylene (HDPE), low-density polyethylene (LDPE), polystyrene, acrylonitrile butadiene styrene (ABS), polycarbonate, polyethylene terephthalate (PET), polypropylene, ethylene-vinyl acetate (EVA), or the like. Suitable foamed plastics may include expanded or extruded polystyrene, expanded or extruded polypropylene, EVA foam, derivatives thereof, and combinations thereof.

Finally, it is intended that the present invention cover the modifications and variations of this invention that come within the scope of the appended claims and their equivalents. For example, it is to be understood that terms such as "left," "right," "top," "bottom," "front," "rear," "side," "height," "length," "width," "upper," "lower," "interior," "exterior," "inner," "outer" and the like as may be used herein, merely describe points of reference and do not limit the present invention to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the invention.

For the purposes of the present disclosure, the phrase "A and/or B" means (A), (B), or (A and B). For the purposes of the present disclosure, the phrase "A, B, and/or C" means (A), (B), (C), (A and B), (A and C), (B and C), or (A, B and C).

Similarly, when used herein, the term "comprises" and its derivations (such as "comprising", etc.) should not be understood in an excluding sense, that is, these terms should not be interpreted as excluding the possibility that what is described and defined may include further elements, steps, etc. Meanwhile, when used herein, the term "approximately" and terms of its family (such as "approximate", etc.) should be understood as indicating values very near to those which accompany the aforementioned term. That is to say, a deviation within reasonable limits from an exact value should be accepted, because a skilled person in the art will understand that such a deviation from the values indicated is inevitable due to measurement inaccuracies, etc. The same applies to the terms "about" and "around" and "substantially".

The invention claimed is:

1. A stackable toy vehicle track assembly comprising:

a base defining a track portion;

a frame extending upwards from the base over the track portion;

a first engagement member disposed at a bottom of the base; and a first receiving member disposed at a top of the frame, so that the first engagement member or the first receiving member can engage a corresponding receiving member or engagement member, respectively, included on a second stackable toy vehicle track assembly to create a vertical stack of toy vehicle track assemblies, wherein the first receiving member and the track portion each comprise laterally extending track tabs configured to engage one or more track members.

2. The stackable toy vehicle track assembly of claim 1, further comprising:

a first tab disposed on a first lateral side of the base; and a first slot disposed in the first lateral side of the base, adjacent the first tab.

3. The stackable toy vehicle track assembly of claim 2, further comprising:

a second tab disposed on a second lateral side of the base; and a second slot disposed in the second lateral side of the base, adjacent the second tab.

4. The stackable toy vehicle track assembly of claim 3, wherein the first tab and the first slot are oppositely aligned as compared to the second tab and the second slot so that the first tab and the first slot can laterally connect the stackable toy vehicle track assembly to the second stackable toy vehicle track assembly when the second stackable toy vehicle track assembly is oriented in a like orientation to the stackable toy vehicle track assembly or a reverse orientation as compared to the stackable toy vehicle track assembly.

5. The stackable toy vehicle track assembly of claim 3, wherein the track portion extends through the base in a first direction and, collectively, the first engagement member, the first receiving member, the first tab and the first slot, and the second tab and the second slot, provide connection points around the first direction.

6. The stackable toy vehicle track assembly of claim 1, further comprising:

a second engagement member disposed on a lateral side of the stackable toy vehicle track assembly; and a second receiving member disposed on the lateral side of the stackable toy vehicle track assembly in alignment with the second engagement member, wherein at least one of the second engagement member or the second receiving member can engage a corresponding receiving member or engagement member, respectively, included on the second stackable toy vehicle track assembly to laterally connect the stackable toy vehicle track assembly and the second stackable toy vehicle track assembly.

7. The stackable toy vehicle track assembly of claim 6, wherein the base comprises an upward extension, the second engagement member and/or the second receiving member are disposed on the upward extension, and one end of the frame connects to a top of the upward extension.

8. The stackable toy vehicle track assembly of claim 1, wherein the first engagement member comprises:

a protrusion having a sidewall;

a finger defined by a plurality of gaps in the sidewall; and a tooth extending laterally from the finger.

9. The stackable toy vehicle track assembly of claim 8, wherein the sidewall extends obliquely from the stackable toy vehicle track assembly.

10. The stackable toy vehicle track assembly of claim 1, wherein the first receiving member comprises a recess defined by a recess sidewall; and a groove disposed in the recess sidewall, the groove being configured to receive a tooth extending laterally from a protrusion of the corresponding engagement member of the second stackable toy vehicle track assembly.

11. The stackable toy vehicle track assembly of claim 10, wherein the recess is tapered and configured to conform to a protrusion sidewall of the first engagement member.

12. The stackable toy vehicle track assembly of claim 1, further comprising:

a rotatable booster wheel disposed in the base, wherein at least a portion of the booster wheel overlaps the track portion so that the booster wheel can engage a toy vehicle traversing the track portion and impart rotational motion to the toy vehicle.

13. A stackable toy vehicle track assembly comprising:

a base having a track portion;

an engagement member disposed at a bottom of the base;

a frame extending upwardly from a first corner of the base, laterally over the track portion, and down to a second corner of the base; and a receiving member disposed at a top of the frame, so that the engagement member or the receiving member can engage a corresponding receiving member or engagement member, respectively, included on a second stackable toy vehicle track assembly to create a vertical stack of toy vehicle track assemblies, wherein the receiving member comprises one or more laterally extending track tabs configured to engage one or more track members.

14. The stackable toy vehicle track assembly of claim 13, further comprising:

a first tab disposed on a first lateral side of the base; and a first slot disposed in the first lateral side of the base, adjacent the first tab.

15. The stackable toy vehicle track assembly of claim 14, further comprising:

a second tab disposed on a second lateral side of the base; and a second slot disposed in the second lateral side of the base, adjacent the second tab, wherein the first tab and the first slot are oppositely aligned as compared to the second tab and the second slot so that the first tab and the first slot can laterally connect the stackable toy vehicle track assembly to the second stackable toy vehicle track assembly when the second stackable toy vehicle track assembly is oriented in a like orientation to the stackable toy vehicle track assembly or a reverse orientation as compared to the stackable toy vehicle track assembly.

16. The stackable toy vehicle track assembly of claim 13, wherein the second corner is diagonal to the first corner.

17. The stackable toy vehicle track assembly of claim 13, wherein the one or more laterally extending track tabs are first track tabs and the track portion further comprises one or more laterally extending, second track tabs configured to engage the one or more track members.

* * * * *